US007731565B2

(12) United States Patent
Shibata et al.

(10) Patent No.: US 7,731,565 B2
(45) Date of Patent: Jun. 8, 2010

(54) EYEGLASS LENS PROCESSING APPARATUS

(75) Inventors: Ryoji Shibata, Toyokawa (JP); Hirokatsu Obayashi, Aichi (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 12/059,544

(22) Filed: Mar. 31, 2008

(65) Prior Publication Data

US 2009/0011687 A1 Jan. 8, 2009

(30) Foreign Application Priority Data

Mar. 30, 2007 (JP) ..... 2007-095741

(51) Int. Cl.
*B24B 49/00* (2006.01)

(52) U.S. Cl. ..... 451/5; 451/8; 451/42; 700/164

(58) Field of Classification Search ..... 451/5, 451/8, 42, 44; 700/164, 172, 179, 184
See application file for complete search history.

(56) References Cited

U.S. PATENT DOCUMENTS

| | | | | |
|---|---|---|---|---|
| 5,333,412 | A | 8/1994 | Matsuyama | |
| 5,775,973 | A * | 7/1998 | Watanabe | 451/5 |
| 5,790,232 | A * | 8/1998 | Hagiwara et al. | 351/177 |
| 6,089,957 | A | 7/2000 | Shibata | |
| 6,095,896 | A * | 8/2000 | Kobayashi | 451/5 |
| 6,099,383 | A * | 8/2000 | Mizuno et al. | 451/5 |
| 6,702,653 | B2 * | 3/2004 | Shibata | 451/42 |
| 6,790,124 | B2 | 9/2004 | Shibata | |
| 7,083,498 | B2 * | 8/2006 | Jinbo et al. | 451/8 |
| 7,083,499 | B2 * | 8/2006 | Jinbo et al. | 451/8 |
| 7,125,315 | B2 * | 10/2006 | Jinbo et al. | 451/8 |
| 7,476,143 | B2 * | 1/2009 | Shibata | 451/5 |
| 7,510,459 | B2 * | 3/2009 | Yamamoto | 451/6 |
| 2007/0202775 | A1 * | 8/2007 | Shibata | 451/5 |
| 2007/0298686 | A1 * | 12/2007 | Shibata | 451/5 |
| 2008/0248721 | A1 * | 10/2008 | Obayashi et al. | 451/5 |
| 2008/0248722 | A1 * | 10/2008 | Takeichi | 451/5 |

(Continued)

FOREIGN PATENT DOCUMENTS

EP 0 196 114 A2 10/1986

(Continued)

OTHER PUBLICATIONS

Extended European Search Report dated Jul. 11, 2008.

*Primary Examiner*—Maurina Rachuba
(74) *Attorney, Agent, or Firm*—Sughrue Mion, PLLC

(57) ABSTRACT

In an eyeglass lens processing apparatus for beveling a peripheral edge of an eyeglass lens, if the high curve lens processing mode is selected by the mode selector, a computing unit acquires a high curve bevel path for locating the bevel apex on a front surface curve of the eyeglass lens or for locating the bevel apex at a position shifted by a predetermined quantity from the front surface curve toward the rear side on the basis of the edge position information acquired by the edge position detector, thereby providing high curve beveling data for the rear surface beveling grindstone, or for the front surface and rear surface beveling grindstones; and a beveling controller bevels the peripheral edge of the eyeglass lens by the rear surface beveling grindstone, or by the front surface and rear surface beveling grindstones on the basis of the high curve beveling data.

8 Claims, 16 Drawing Sheets

U.S. PATENT DOCUMENTS

| | | | | |
|---|---|---|---|---|
| 2009/0011687 | A1 * | 1/2009 | Shibata et al. | 451/240 |

FOREIGN PATENT DOCUMENTS

| | | | |
|---|---|---|---|
| EP | 0 802 020 | A1 | 10/1997 |
| EP | 0894568 | A | 2/1999 |
| EP | 0953405 | A2 | 11/1999 |
| EP | 1238733 | A1 | 9/2002 |
| EP | 1591199 | A2 | 11/2005 |
| JP | 02-212059 | A | 8/1990 |
| JP | 04-093164 | A | 3/1992 |
| JP | 2003-145328 | A | 5/2003 |
| JP | 2006-239782 | A | 9/2006 |

* cited by examiner

EYEGLASS LENS PROCESSING APPARATUS

BACKGROUND OF THE INVENTION

The present invention relates to an eyeglass lens processing apparatus for processing a peripheral edge of an eyeglass lens.

There is a previously known eyeglass lens processing apparatus for processing a peripheral edge of an eyeglass lens (hereinafter also simply referred to as a lens) to be fitted in an eyeglass frame, in which bevels are formed at the lens peripheral edge by a beveling grindstone having a V-groove to simultaneously process a bevel slope on a front side of the eyeglass lens and a bevel slope on a rear side of the eyeglass lens (for example, see U.S. Pat. No. 6,095,896 (JP-A-11-70451)).

Further, there is a previously known eyeglass lens processing apparatus having a front surface beveling grindstone for processing the bevel slope on the front side of the eyeglass lens and a rear surface beveling grindstone for processing the bevel slope of the rear side of the eyeglass lens in order to suppress changes in the bevel size being likely to occur in the grindstone having the V-groove, thereby individually processing the front surface and rear surface of the bevel (for example, see U.S. Pat. No. 6,089,957 (JP-A-11-48113), hereinafter referred to as Patent Reference 2).

In recent years, the design of an eyeglass frame has been diversified and many eyeglass frames having a steep frame curve have been proposed. In this case, the eyeglass lens also has a steep curve according to the frame curve ("high curve lens"). In beveling this high curve lens, by using the apparatus described in Patent Reference 2, beveling can be carried out while suppressing the thinning of the bevel. However, in this apparatus also, further improvements in a practical aspect such as shortening the processing time and forming the bevel with good appearance are demanded.

SUMMARY OF THE INVENTION

It is a technical problem of the invention to provide an eyeglass lens processing apparatus capable of appropriately processing a bevel with good appearance without lengthening the processing time also in the case of a high curve lens.

In order to resolve the above-described situation, the invention is characterized in providing the following structures.

(1) An eyeglass lens processing apparatus for beveling a peripheral edge of an eyeglass lens, comprising:

a pair of lens chuck axes for holding the eyeglass lens;

a beveling grindstone including a V-groove beveling grindstone for simultaneously processing a bevel slope on a front side of the eyeglass lens and a bevel slope on a rear side of the eyeglass lens, and a front surface beveling grindstone and a rear surface beveling grindstone for individually processing the bevel slope on the front side and the bevel slope on the rear side, respectively;

a lens edge position detector for detecting edge positions of a front surface and a rear surface of the eyeglass lens on the basis of target lens shape data;

a mode selector for selecting a low curve lens processing mode and a high curve processing mode;

a computing unit for acquiring, if the low curve lens processing mode is selected by the mode selector, a low curve bevel path for locating a bevel apex between the front surface and rear surface of the eyeglass lens using a predetermined computing equation on the basis of edge position information acquired by the edge position detector, thereby providing low curve beveling data for the V-groove beveling grindstone; and acquiring, if the high curve lens processing mode is selected by the mode selector, a high curve bevel path for locating the bevel apex on a front surface curve of the eyeglass lens or for locating the bevel apex at a position shifted by a predetermined quantity from the front surface curve toward the rear side on the basis of the edge position information acquired by the edge position detector, thereby providing high curve beveling data for the rear surface beveling grindstone, or for the front surface and rear surface beveling grindstones; and a beveling controller for beveling, in the low curve lens processing mode, the peripheral edge of the eyeglass lens by the V-groove beveling grindstone on the basis of the low curve beveling data, and beveling, in the high curve lens processing mode, the peripheral edge of the eyeglass lens by the rear surface beveling grindstone, or by the front surface and rear surface beveling grindstones on the basis of the high curve beveling data.

(2) The eyeglass lens processing apparatus according to (1), wherein when the high curve processing mode is selected to acquire the high curve bevel path for locating the bevel apex at the position shifted from the front surface curve of the eyeglass lens by the predetermined quantity toward the rear side, the computing unit acquires the high curve bevel path while the shifting quantity toward the rear side of the eyeglass lens changes according to an edge thickness of the eyeglass lens obtained by the lens edge position detector.

(3) The eyeglass lens processing apparatus according to (1), wherein when the high curve processing mode is selected, the computing unit acquires, if an edge thickness of the eyeglass lens obtained by the lens edge position detector is not larger than a predetermined thickness, the high curve bevel path for locating the bevel apex on the front surface curve of the eyeglass lens, and acquires, if the edge thickness of the eyeglass lens obtained by the lens edge position detector is larger than the predetermined thickness, the high curve bevel path for locating the bevel apex on the front surface curve shifted toward the rear side of the eyeglass lens.

(4) The eyeglass lens processing apparatus according to (1), wherein an angle of the beveling slope of the rear surface beveling grindstone relative to an axial direction of the lens chuck axes is larger than an angle of the rear surface beveling slope of the V-groove beveling grindstone relative to the axial direction of the lens chuck axes, and an angle of the beveling slope of the front surface beveling grindstone relative to the axial direction of the lens chuck axes is smaller than an angle of the front surface beveling slope of the V-groove beveling grindstone relative to the axial direction of the lens chuck axes.

(5) The eyeglass lens processing apparatus according to (1), wherein the rear surface beveling grindstone includes a rear side beveling slope and a bevel foot processing slope for forming a bevel foot on the rear side thereof, and an angle of the bevel foot processing slope relative to an axial direction of the lens chuck axes is smaller than an angle of the rear side beveling slope relative to the axial direction of the lens chuck axes.

(6) The eyeglass lens processing apparatus according to (1), wherein the rear surface beveling grindstone includes a rear side beveling slope and a bevel foot processing slope for forming a bevel foot on the rear side thereof, an angle of the bevel foot processing slope relative to the axial direction of the lens chuck axes is smaller than an angle of the rear side beveling slope relative to an axial direction of the lens chuck axes, and (7) the computing unit acquires the high curve beveling data in which a height of the bevel apex relative to the bevel foot when the bevel slope is processed changes according to material of an eyeglass frame inputted by a frame material inputting unit.

The eyeglass lens processing apparatus according to (6), wherein the computing unit acquires the high curve beveling data in which the bevel apex is located at a higher position when the material of the eyeglass lens frame is plastic than when the material is metal.

(8) An eyeglass lens processing apparatus for beveling a peripheral edge of an eyeglass lens, comprising:

a pair of lens chuck axes for holding the eyeglass lens;

a beveling grindstone including a V-groove beveling grindstone for simultaneously processing a bevel slope on a front side of the eyeglass lens and a bevel slope on a rear side of the eyeglass lens, and a front surface beveling grindstone and a rear surface beveling grindstone for individually processing the bevel slope on the front side of the eyeglass lens and the bevel slope on the rear side of the eyeglass lens, respectively, wherein rear surface beveling grindstone includes a rear side beveling slope and a bevel foot processing slope for forming a bevel foot, and an angle of the bevel foot processing slope relative to an axial direction of the lens chuck axes is smaller than an angle of the rear side beveling slope relative to the axial direction of the lens chuck axes;

a lens edge position detector for detecting edge positions of a front surface and a rear surface of the eyeglass lens on the basis of target lens shape data;

a mode selector for selecting a low curve lens processing mode and a high curve processing mode;

a computing unit for acquiring, if the low curve lens processing mode is selected by the mode selector, a low curve bevel path for locating a bevel apex between the front surface and the rear surface of the eyeglass lens using a predetermined computing equation on the basis of edge position information acquired by the edge position detector, thereby providing low curve beveling data for the V-groove beveling grindstone; and acquiring, if the high curve lens processing mode is selected by the mode selector, a high curve bevel path for locating the bevel apex on a front surface curve of the eyeglass lens or for locating the bevel apex at a position shifted by a predetermined quantity from the front surface curve toward the rear side on the basis of the edge position information acquired by the edge position detector, thereby providing high curve beveling data for the rear surface beveling grindstone, or for the front surface beveling grindstone and rear surface beveling grindstone; and a beveling controller for beveling, in the low curve lens processing mode, the peripheral edge of the eyeglass lens by the V-groove beveling grindstone on the basis of the low curve beveling data, and beveling, in the high curve lens processing mode, the peripheral edge of the eyeglass lens by the rear surface beveling grindstone, or by the front surface beveling grindstone and rear surface beveling grindstone on the basis the high curve beveling data.

DETAILED DESCRIPTION OF PREFERRED EMBODIMENTS

Figure 1:
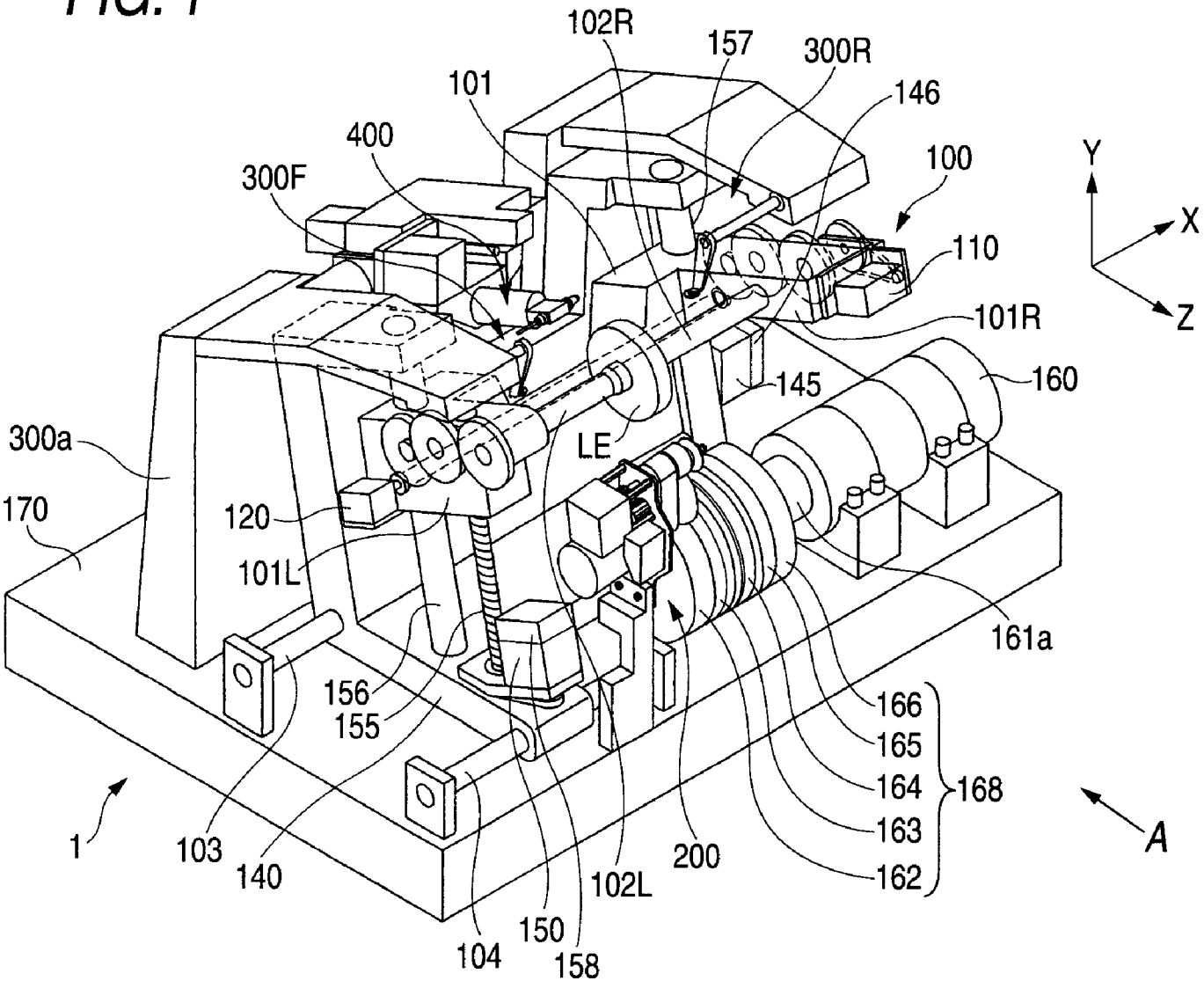
FIG. 1 is a view for explaining the processing unit of an eyeglass lens processing apparatus according to the present invention.

Now referring to the drawings, an embodiment of the invention will be explained as follows. FIG. 1 is a schematic structure view of a processing unit in an eyeglass lens peripheral edge processing apparatus according to the invention.

A carriage portion 100 is mounted on a base 170. An eyeglass lens LE to be processed is held (chucked) by lens chuck axes (lens rotating axes) 102L, 102R of a carriage 101, and a peripheral edge of the lens is pressed and processed by a grindstone group 168 coaxially attached to a grindstone spindle 161*a*. The grindstone group 168 is constituted by a roughing grindstone 162 for a glass, a high curve bevel-finishing (beveling) grindstone 163 for having a bevel slope to form a bevel in a high curve lens, a finishing grindstone 164 having a V-groove (bevel groove) VG and a flat processing plane to form the bevel in a low curve lens, a flat-polishing grindstone 165 and a roughing grindstone 166 for plastic. The grindstone 161*a* is rotated by a motor 160.

The lens chuck axis 102L is held by a left arm 101L of the carriage 101 and the lens chuck axis 102R is held by a right arm 101R of the carriage 101 rotatably and coaxially. The lens chuck axis 102R is moved toward the lens chuck axis 102L by a motor 110 attached to the right arm 101R, and the lens LE is held by the lens chuck axes 102R and 102L. Further, the two lens chuck axes 102R and 102L are rotated in synchronization with each other by a motor 120 attached to the left arm 101L through a rotation transmission mechanism such as a gear. These components constitute a lens rotating unit.

The carriage 101 is mounted on a moving support base 140 which is movable along shafts 103 and 104 extending in parallel to the lens chuck axes 102R, 102L and grindstone spindle 161*a*. A ball screw (not shown) extending in parallel to the shaft 103 is attached to the rear of the moving support base 140. The ball screw is attached to the rotating shaft of an X axis direction moving motor 145. By the rotation of the motor 145, the carriage 101 as well as the moving support base 140 is linearly moved in the X-axis direction (axial direction of the lens chuck axes). These components constitute an X-axis direction moving unit. The rotating shaft of the motor 145 is provided with an encoder 146 for detecting the X-axis direction movement of the carriage 101.

The supporting base 140 is fixed with shafts 156 and 157 extending in the Y-axis direction (direction in which the axis-to-axis distance between the lens chuck axes 102R, 102L and the grindstone spindle 161*a* is changed). The carriage 101 is mounted on the supporting base 140 so that it is movable in the Y-axis direction along the shafts 156 and 157. In the supporting base 140, a Y-axis direction moving motor 150 is fixed. The rotation of the motor 150 is transmitted to a ball screw 155 extending in the Y-axis direction. By the rotation of the ball screw 155, the carriage 101 is moved in the Y-axis direction. These components constitute a Y-axis direction moving unit. The rotating shaft of the motor 150 is provided with an encoder 158 for detecting the Y-axis direction movement of the carriage 101.

Referring to FIG. 1, a chamfering mechanism 200 is arranged on the front side of the apparatus body. The chamfering mechanism 200, which is well known, will not be explained here (see, for example, JP-A-2006-239782).

Figure 2:
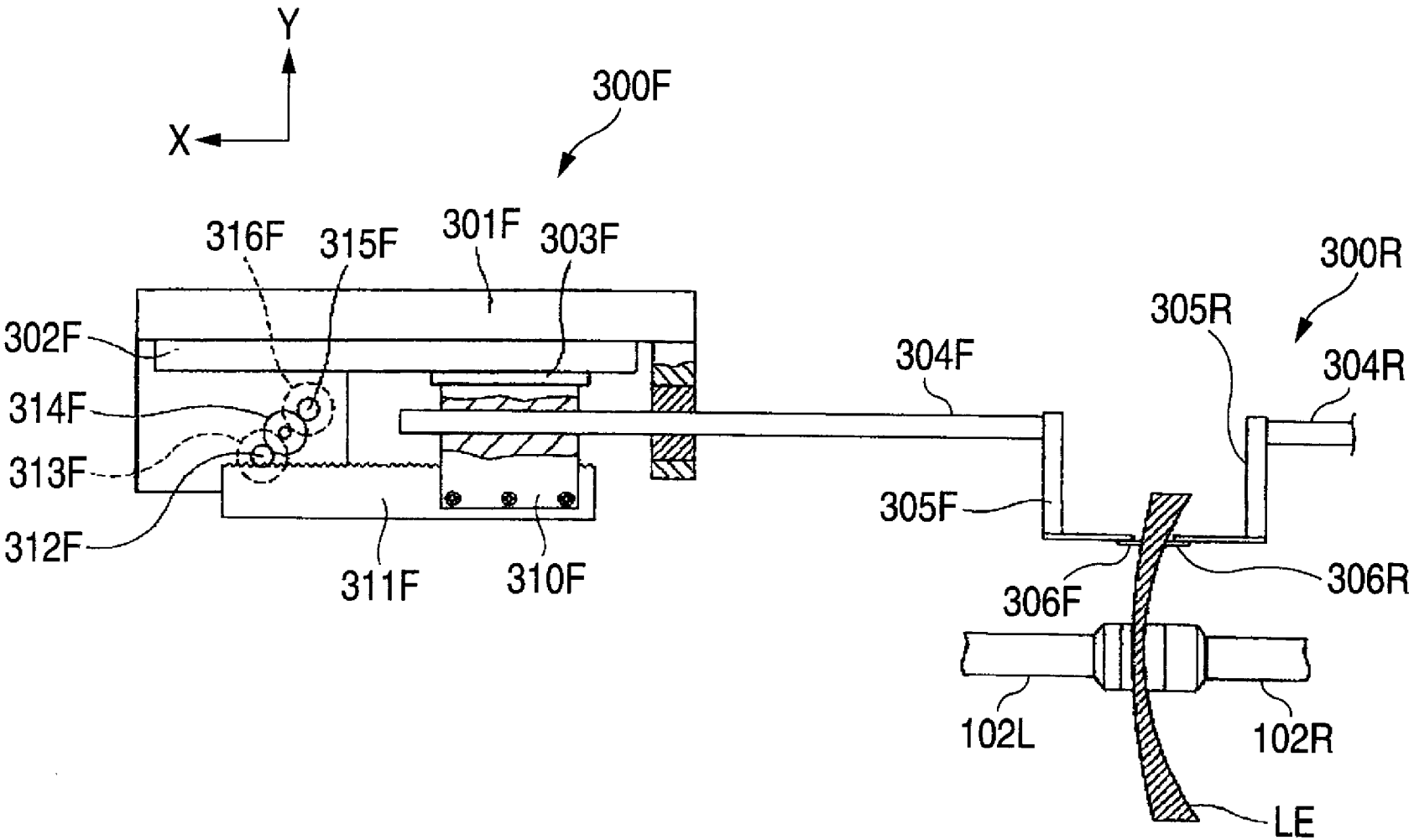
FIG. 2 is a view for explaining a measuring unit.

Referring to FIG. 1, lens edge position measuring portions (lens shape measuring portions) 300F and 300R are arranged on the carriage 101. FIG. 2 is a schematic structure view of the lens measuring portion 300F for measuring the lens edge position on the lens front surface. An attached support base 301F is fixed to a support base block 300*a* fixed on the base 170 in FIG. 1. A slider 303F is slidably attached on a rail 302F fixed on the attached support base 301F. A slide base 310F is attached to the slider 303F. A tracing stylus arm 304F is fixed to the slide base 310F. An L-shape hand 305F is fixed to the tip of the tracing stylus arm 304F, and a tracing stylus (feeler) 306F is fixed to the tip of the hand 305F. The tracing stylus 306F is brought into contact with the front reflecting surface of the eyeglass lens LE.

A lower end of the slide base 310F is fixed with a rack 311F. The rack 311F is brought in mesh with a pinion 312F of an encoder 313F fixed to the attached support base 301F. Rotation of the motor 316F is transmitted to the rack 311F by way of a gear 315F, an idle gear 314F and the pinion 312F, and slide base 310F is moved in the X axis direction. While the lens edge position is measured, the motor 316F presses the tracing stylus 306F to the eyeglass lens LE always by a constant force. The tracing stylus 306F is pressed to a lens refractive surface with a light force by the motor 316F so that the lens refractive surface is not scratched. The means for giving the pressing force of the tracing stylus 306F to the lens refractive surface may be a well known pressure giving means such as a spring. The encoder 313F detects the moving position of the slide base 310F thereby to detect the moving position of the tracing stylus 306F in the X-axis direction. The edge position (inclusive of the lens front surface position) on the front surface of the eyeglass lens LE is measured using the information on the moving position, the information on the rotating angle of the lens chuck axes 102L and 102R and their moving information in the Y-axis direction.

The lens measuring portion 300R for measuring the edge position of a rear surface of the eyeglass lens LE is symmetrical with the lens measuring portion 300F in a left and right direction, and therefore, with "R" substituted for "F" at the ends of the symbols appended to the respective constituent elements of the measuring portion 300F in FIG. 2, an explanation of the structure thereof will be omitted.

The lens edge position will be measured in such a manner that the tracing stylus 306F is brought into contact with the front surface of the eyeglass lens LE and the tracing stylus 306R is brought into contact with the rear surface of the eyeglass lens LE. In this state, the carriage 101 is moved in the Y axis direction on the basis of a target lens shape data, and the eyeglass lens LE is rotated to thereby simultaneously measure edge data of the front surface of the eyeglass lens LE and the rear surface of the lens for processing the lens peripheral edge. In an edge position measuring unit in which the tracing stylus 306F and the tracing stylus 306R are integrally movable in the X-axis direction, the lens front surface and lens rear surface are measured separately. Further, in the lens edge position measuring portion, it is assumed that the lens chuck axes 102L and 102R move in the Y-axis direction, but the tracing styluses 306F and 306R may move relatively in the Y-axis direction. The lens edge position may be acquired by computation on the basis of design data of the eyeglass lens LE.

Referring to FIG. 1, a drilling and grooving mechanism 400 is arranged on a rear side of the carriage portion 100. The structure of the carriage portion 100, the lens edge position measuring portion 300F and 300R and the drilling and grooving mechanism 400, which may be those described in U.S. Pat. No. 6,790,124 (JP-A-2003-145328), will not be explained in detail.

The X-axis direction moving unit and Y-axis direction moving unit in the eyeglass lens peripheral edge processing apparatus shown in FIG. 1 may have a configuration in which the grindstone 161*a* is moved relatively to the lens chuck axes (102L, 102R) in the X-axis direction and Y-axis direction. Further, the lens edge position measuring portion 300F and 300R may also have a configuration in which the tracing styluses 306F and 306R are moved relatively to the lens chuck axes (102L, 102R) in the Y-axis direction.

Figure 3:
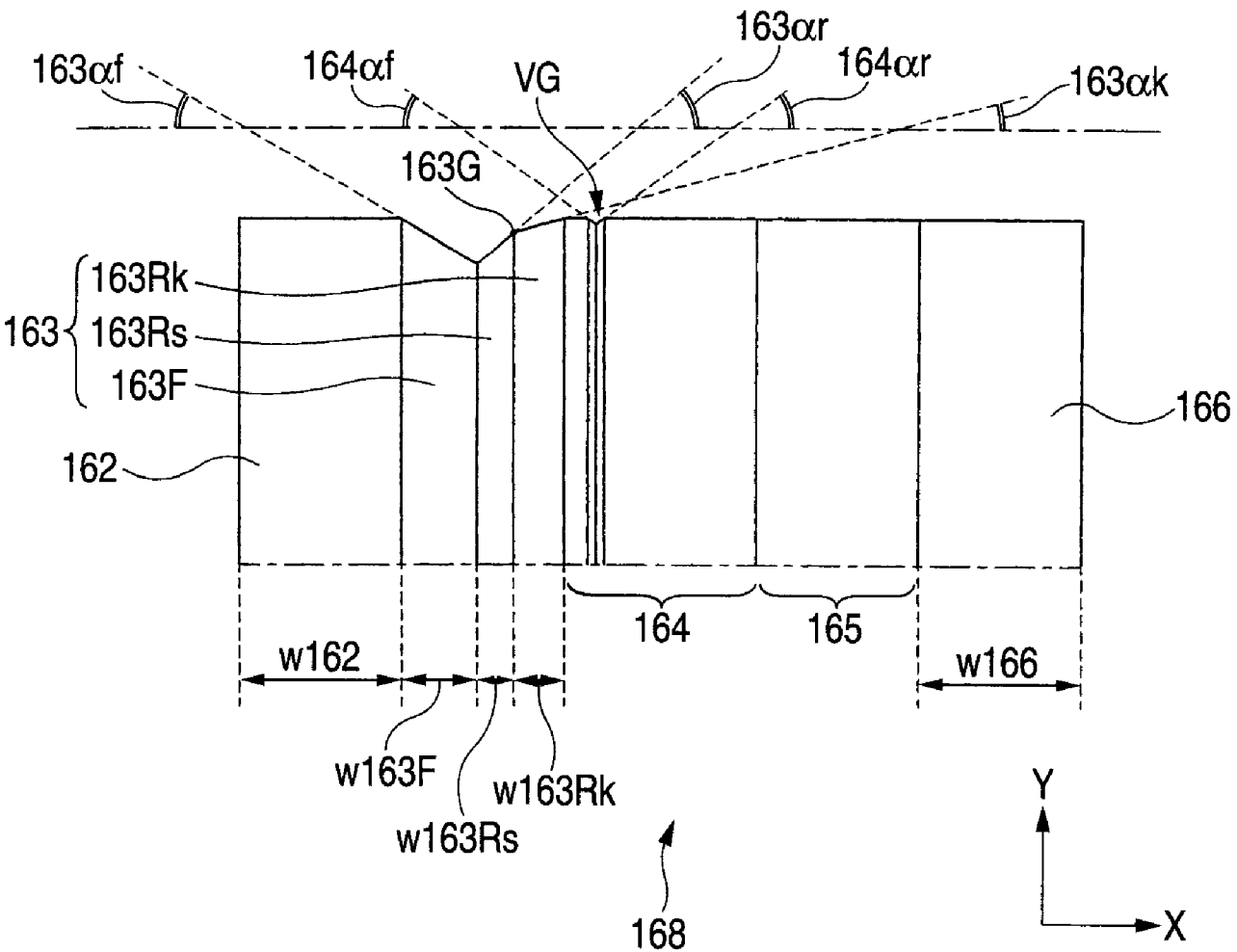
FIG. 3 is a view for the construction of a grindstone group.

Now, the structure of the grindstone group 168 will be explained. FIG. 3 is a view when the grindstone group 168 is seen from the direction of an arrow A in FIG. 1. The width w162 of the roughing grindstone 162 for a glass and the width w166 of the roughing grindstone 166 for plastic are both 17 mm. Usually, since the edge thickness of the eyeglass lens LE is 15 mm or less, correspondingly, the width w162 and w166 are made as narrow as possible.

With respect to the V-groove for beveling of the finishing grindstone 164 for a low curve, the angle 164 $\alpha f$ of a front surface processing slope and the angle 164$\alpha r$ of a rear surface processing slope relative to the X-axis direction are both set at 35° in order to give a good appearance when the eyeglass lens LE with a gentle frame curve is fitted in. The depth of the V groove VG is smaller than 1 mm.

The high-curve bevel-finishing (beveling) grindstone 163 includes a front surface beveling grindstone having a front surface beveling slope 163F for processing the bevel slope on the front side of the eyeglass lens LE, and a rear surface beveling grindstone having a rear surface beveling grindstone slope 163Rs on the rear side of the eyeglass lens LE and a rear bevel foot processing slope 163Rk for a bevel foot on the rear side of the eyeglass lens LE. In this apparatus, the grindstones for the respective processed slopes are formed integrally, but may be provided individually.

The angle 163$\alpha f$ of the front surface beveling slope 163F relative to the X-axis direction is smaller than the angle 164$\alpha f$ of the front surface processing slope of the finishing grindstone 164, e.g. 30°. Where the front surface bevel is formed in the high curve lens, the frame curve of the eyeglass lens LE (frame curve of the frame in which the eyeglass lens LE is fitted) is steep. Thus, in order to give the good appearance of the front side, the angle 163$\alpha f$ of the front surface bevel is preferably made small for the low curve lens. On the other hand, the angle 163$\alpha r$ of rear surface beveling grindstone slope 163Rs relative to the X-axis direction is larger than the angle 164$\alpha r$ of the front surface processing slope of the finishing grindstone 164, e.g. 45°. In the high curve lens, in order that the eyeglass lens LE does not come off on the rear side and is surely held, the angle 163$\alpha r$ of rear surface bevel is made preferably large as compared with the low curve lens. Further, the angle 163$\alpha k$ of the rear bevel foot processing slope 163Rk relative to the X-axis direction is larger than the angle of the rear surface bevel foot processing slope 163Rk of the finishing grindstone 164 (in FIG. 3, 0°, but is set at not larger than 3°), e.g. 15°. Thus, when the eyeglass lens LE is attached to the high curve frame, the eyeglass lens LE provides good appearance and can be easily held.

Further, the width w163F of the front surface beveling slope 163F relative to the X-axis direction is set at 9 mm and the width w163Rs of the rear surface beveling slope 163Rs is set at 3.5 mm. As described later, in the case of the high curve lens, the front side bevel slope and the rear side bevel slope are processed separately so that they are set at the width larger than those of the finishing grindstone 164 for a low curve, respectively. The width w163Rk of the rear side bevel foot processing slope 163Rk is set at 4.5 mm.

Figure 4:
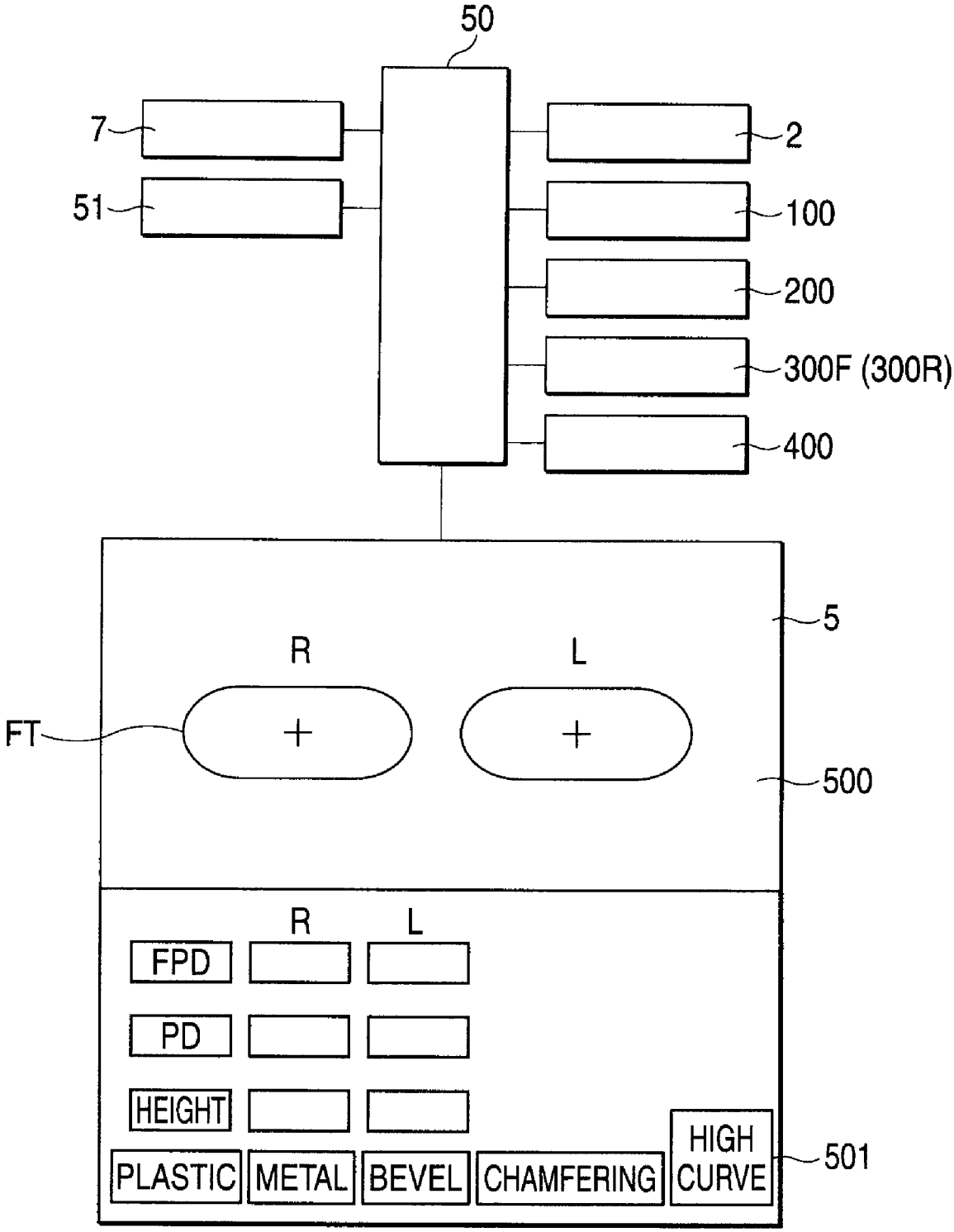
FIG. 4 is a view for explaining a control system.

FIG. 4 is a control block diagram of the eyeglass lens peripheral edge processing apparatus. A control unit 50 is connected with an eyeglass frame shape measuring unit 2 (which may be that described in U.S. Pat. No. 533,412 (JP-A-4-93164)), a display 5 serving as a touch panel type of display device and input device, a switch unit 7, a memory 51, the carriage portion 100, the chamfering mechanism 200, the lens edge position measuring portions 300F, 300R, the drilling and grooving mechanism 400 and others. An input signal to the apparatus can be inputted by touching the display on the display 5 with a touch pen (or a finger). The control unit 50 receives the input signal by the touch panel function of the display 5 to control the display of the graphic and information of the display 5.

Next, an explanation will be given of the measuring operation of the lens edge position, roughing operation for the high curve lens and beveling operation for the high curve lens by the apparatus having the construction described above.

First, the target lens shape data (rn, θn) (n=1, 2, . . . N) of the eyeglass frame measured by the eyeglass frame shape measuring unit 2 are inputted by depressing the switches of the switch unit 7 and stored in the memory 51. In the target lens shape data, rn represents a radius vector length and θn represents a radius vector angle. The target lens shape FT is displayed on the screen 500 of the display 5. A state where the layout data inclusive of the PD (pupillary distance) value of a wearer, FPD (frame pupillary distance) value of the eyeglass frame and the height of an optical center relative to the geometric center of the target lens shape can be inputted is provided. The layout data can be inputted by manipulating predetermined button keys displayed on the display 5. Further, the processing conditions such as the material of the eyeglass lens LE, kind of the frame, processing mode (beveling, flat-processing and grooving) and presence or absence of chamfering can be also set by manipulating predetermined button keys displayed on the display 5. Now, an explanation will be given of the case where the beveling mode is set.

If it is previously known that the frame curve of the eyeglass lens frame is large, a high curve mode can be selected beforehand by a predetermined button key 501 displayed on the display 5. If the high curve mode is selected beforehand, using the grindstone 163 for the high curve beveling (hereinafter, referred to as a high curve beveling grindstone) is set. Where the frame curve of the eyeglass lens frame is not steep and so the finishing grindstone 164 is used, the normal processing mode may be selected beforehand. Where the beveling is selected in conformity with the eyeglass lens frame with the high frame curve, the eyeglass lens LE is also selected so as to conform to the high curve.

Once the data necessary for the processing could be inputted, the eyeglass lens LE is chucked by the lens chuck axes 102R and 102L and the start switch of the switch unit 7 is depressed to start the apparatus.

The control unit 50 actuates the measuring portions 300F, 300R on the basis of the target lens shape data to measure the edge positions of the front surface and rear surface of the eyeglass lens LE.

Figure 5A:
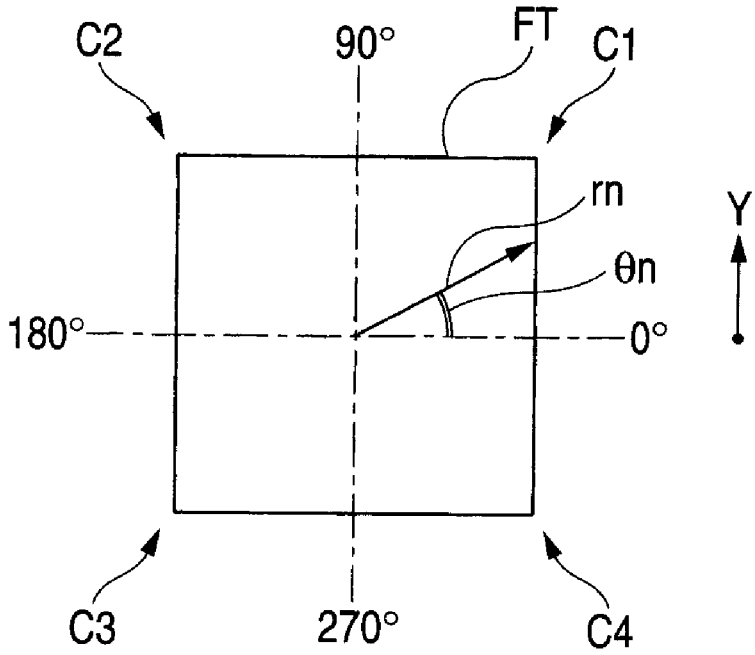
FIGS. 5A to 5B are views for explaining measurement of the edge position of an eyeglass lens.
Figure 5B:
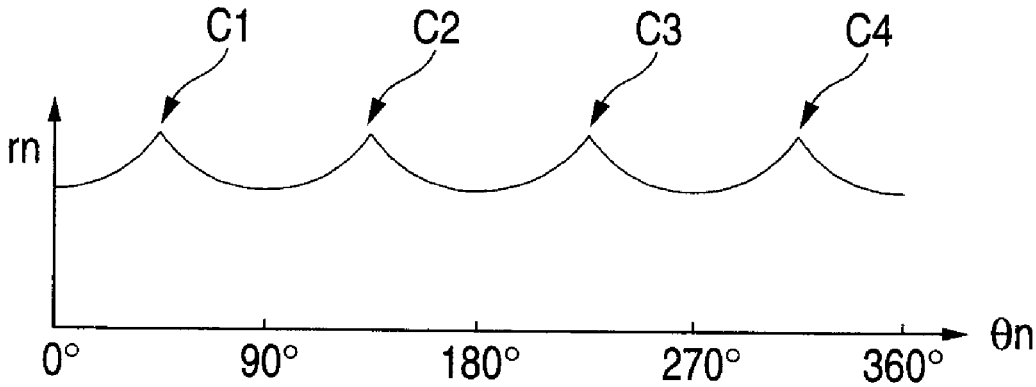

Referring to FIGS. 5A to 5B and FIGS. 6A to 6B, an explanation will be given of the edge positions of the lens front surface and lens rear surface. FIG. 5A illustrates the target lens shape FT and geometrical center FC. In FIG. 5A, the position of the target lens shape data (rn, θn) (n=1, 2, . . . , N) relative to the geometrical center FC is also illustrated. In the target lens shape data, rn represents the radius vector length and θn represents the radius vector angle. As seen from FIG. 5A, it is assumed that the radius vector angle θn increases counterclockwise with the radius vector angle θn on the right side in the figure being 0° with reference to the geometrical center FC. FIG. 5B is a graph showing changes in the radius vector length rn for the radius vector angle θn.

Figure 6A:
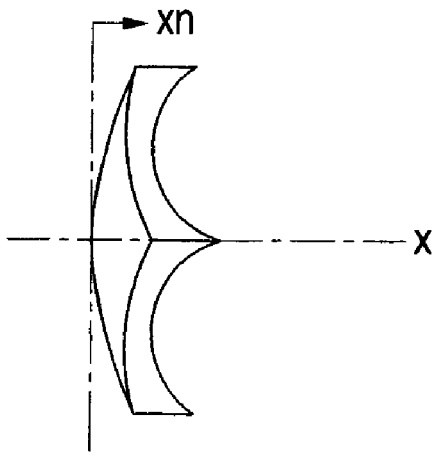
FIGS. 6A to 6B are views for explaining measurement of the edge position of an eyeglass lens.
Figure 6B:
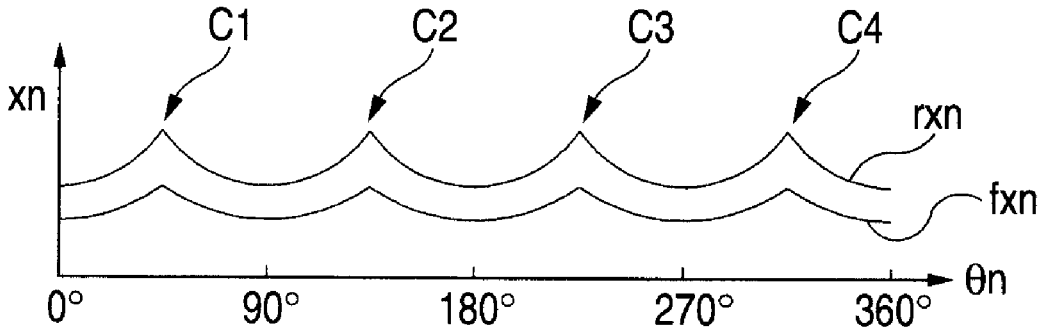

Further, FIG. 6A is a view when the lens edge is seen from the direction of corner C1 where the eyeglass lens LE is processed with the target lens shape FT. FIG. 6B is a graph showing the edge position fxn of the lens front side refractive surface and the edge position rxn of the lens rear side refractive surface for the radius vector angle θn of the target lens shape FT shown in FIG. 5A. These positions represent the distances for the reference position in the X-axis direction.

Where the edge position of the eyeglass lens LE is measured on the basis of the target lens shape FT, while rotating the lens chuck axes 102R, 102L, the control unit 50 moves the lens chuck axes 102R, 102L in the Y-axis direction on the basis of the radius vector length rn for each radius vector angle θn of the target lens shape (in this case, the radius vector angle θn represents the rotating angle of the eyeglass lens LE) thereby controlling the positions in the Y-axis direction of the tracing stylus 306F to be in contact with the lens front surface and the tracing stylus 306R to be in contact with the lens rear surface. During the measurement, the tracing styluses 306F and 306R are pressed on the lens refractive surfaces by light force by the motors 316F and 316R, respectively. The edge positions fxn and rxn are acquired by the encoders 313F and 313R, respectively.

Next, an explanation will be given of the case where the lens chuck axes 102R, 102L are rotated at an equiangular speed. If the rotating speed of the lens chuck axes 102R, 102L is increased, the measuring time can be shortened. However, in the vicinity of the corners C1 to C4 which are inflecting points where the radius vector length rn of the target lens shape FT abruptly changes, as described above, the positions of the tracing styluses 306F and 306R in the Y-axis direction abruptly change. Correspondingly, the edge positions fxn and rxn also abruptly change in the vicinity of the corners C1 to C4. Particularly, at the corners C1 to C4, the radius vector length rn and the edge positions fxn, rxn turn from "increase" to "decrease". At this time, if the rotating speed of the eyeglass lens LE is too fast, owing to the influence of e.g. an inertial force, the trackability in the X-axis direction of the tracing styluses 306F and 306R for the refractive surfaces of the eyeglass lens LE will be deteriorated. As regards the tracing stylus 306R for measuring the edge position of the lens rear surface, its trackability after the radius vector length rn turns from "increase" to "decrease" at corner C1 will be deteriorated, thereby deteriorating the measuring accuracy.

As regards the tracing stylus 306F for measuring the edge position of the lens front surface, owing to an abrupt change in the radius vector length Rn in the vicinity of corner C1, the edge position also changes abruptly. Thus, its trackability in this vicinity will be deteriorated, thereby deteriorating the measuring accuracy. Further, as the lens curve becomes steep, this tendency increases.

In the range where the radius vector rn abruptly changes so that it turns from "increase" to "decrease", the tracing styluses 306F and 306R cannot follows abrupt moving control in the Y-axis direction of the lens chuck axes 102L and 102R so that they may come off the radius vector path of the target lens shape FT.

On the other hand, assuming that the eyeglass lens LE is rotated at a constant speed, in order to assure the measuring accuracy at the corners C1 to C4 where the radius vector length rn abruptly changes, if the rotating speed of the eyeglass lens LE is sufficiently reduced, the measuring time will be lengthened. Particularly, in the case of beveling, since the edge positions are measured at two points of the bevel apex and the bevel bottom, if the one round measurement time is lengthened, the total processing time will be further lengthened.

Now, in the target lens shape FT, at the areas farther from the corners C1 to C4 (in FIGS. 5A to 5B, the vicinity of 0°, 90°, 180° and 270°), the changing amount in the radius vector length rn is relatively small and the changing amount in the edge position is also small. In these ranges, even if the rotating speed of the eyeglass lens LE is increased, the trackability of the tracing styluses 306F, 306R for the lens refractive surfaces can be ensured.

In view of the above fact, in order to shorten the measuring time, according to the change in the radius vector length rn, the rotating speed of the lens chuck axes 102R, 102L (the rotating speed of the eyeglass lens LE) is changed. Specifically, in the range where the change in the radius vector length rn is large, the rotating speed of the eyeglass lens LE is decreased thereby to ensure the measuring accuracy. On the other hand, in the range where the change in the radius vector length rn is small, the rotating speed of the eyeglass lens LE is increased thereby to shorten the measuring time.

Figure 7A:
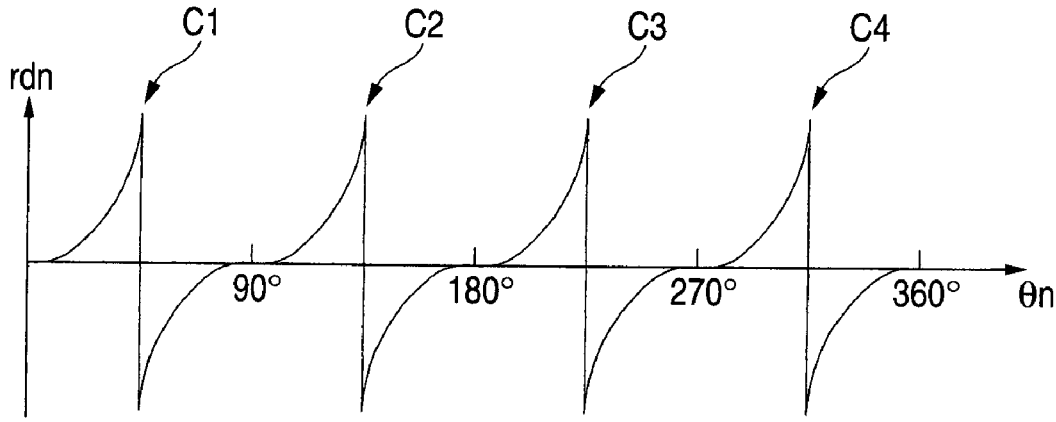
FIGS. 7A to 7C are views for explaining control of an eyeglass lens rotating speed.
Figure 7B:
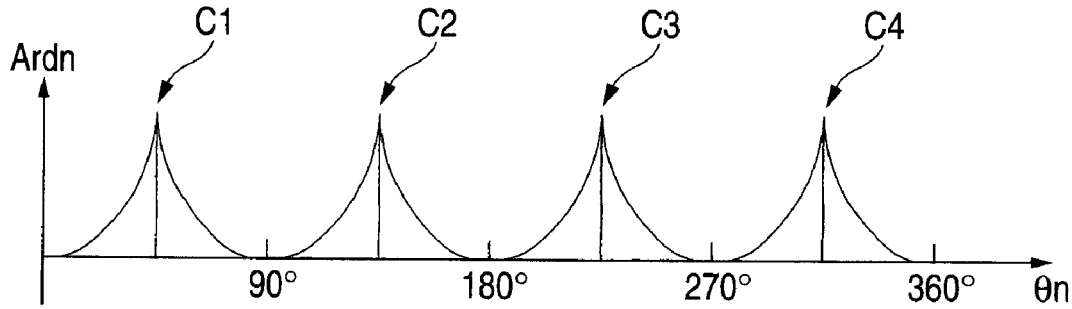
Figure 7C:
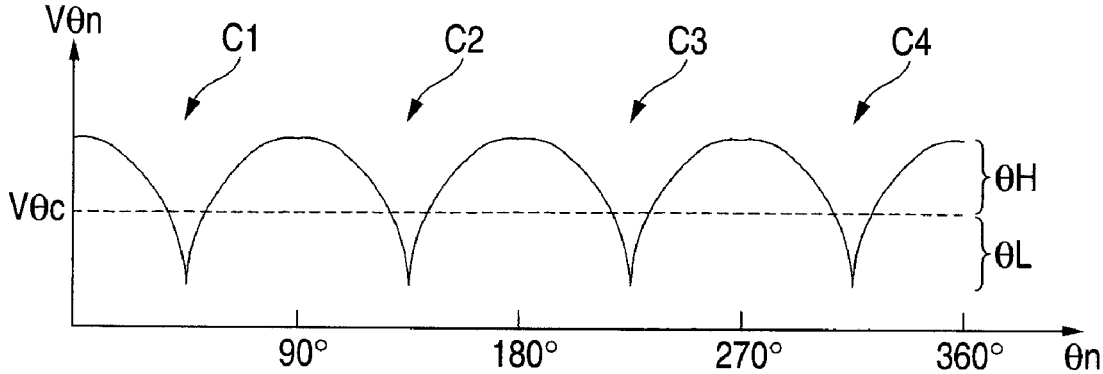

Now referring to FIGS. 7A to 7C, an explanation will be given of a preferred example of the lens rotating speed control. The control unit 50 differentiates the radius vector length rn of the target lens shape data (rn, θn) of the eyeglass lens frame shown in FIG. 5A with respect to the radius vector angle θn. Assuming that the edge position on the path of the target lens shape is measured at 1000 points for one turn, the radius vector angle θn is changed for each 0.36°. The relationship of the differentiation result (differentiated value) of rdn with the radius vector angle θn is shown in the graph of FIG. 7A. Next, the control unit 50 computes the absolute value of the differentiated value thus acquired. The relationship of the absolute value Ardn thus computed with the radius vector angle θn is shown in FIG. 7B. As seen from FIG. 7B, at the corners C1 to C4 of four points of the target lens shape FT, the absolute value Ardn is large.

The control unit 50 changes the angular speed of rotating the chuck axes 102R, 102L according to the absolute value Ardn. This changing of the angular speed will be explained. In the control unit 50, as shown in FIG. 7C, with respect to the radius vector angle θn, the rotation angular speed Vθn nearly inversely proportional to the absolute value Ardn is acquired. The chuck axes 102R, 102L are rotated at the rotation angular speed thus acquired. Specifically, in the range where the changing rate of the radius vector length rn is small, the lens chuck axes 102R, 102L are rotated at a high speed. As the changing rate of the radius vector length increases, they are rotated at a lower speed. The rotation angular speed Vθn can be experimentally determined so that the tracing styluses 306F, 306R can track the refractive surfaces even in the range where the absolute value Ardn which represents the changing rate of the radius vector length rn (changing amount for a unit rotating angle) is large like the corners C1 to C4.

In this way, by rotating the lens chuck axes 102R, 102L at the rotation angular speed Vθn according to the changing rate of the radius vector length rn, the speed in the Y-axis direction of the tracing styluses 306F, 306R moving along the refractive surfaces of the eyeglass lens LE can be made nearly constant. Thus, while ensuring the measuring accuracy, with the measuring time shortened, the edge positions of the refractive surfaces of the eyeglass lens LE can be measured.

Hitherto, the explanation has been given of the case where the refractive surfaces of the eyeglass lens LE are measured using the rotation angular speed Vθn being in an inverse relationship with the absolute value Ardn. However, the computation of the rotation angular speed Vθn according to changes in the radius vector length rn is not limited to such a case. For example, the rotation angular speed Vθn in FIG. 7C may be changed stepwise so that it is changed in two steps of a high speed VθL and a low speed VθH across the boundary of the rotation angular speed of Vθc. The number of the steps to change is not 2 but may be 3 or over.

In the above description, the rotation angular speed Vθn is changed on the basis of the changing rate of the radius vector length rn of the target lens shape FT, but may be changed also considering a change in the lens refractive surfaces in the X-direction. With the same target lens shape FT, if the eyeglass lens LE is thick, for example, it is a minus lens with a steep curve, or the high curve lens, the change in the edge position in the X-axis direction for the change in the radius vector angle θn becomes large. In the process measuring the edge position, if the change in the detected result appears as a large amount in either the tracing stylus 306F or the tracing stylus 306R as the measured result by the tracing styluses 306F, 306R, estimating that the subsequent change also becomes large, the control unit 50 controls the rotation angular speed Vθn to be decreased. Afterward, if the change in the detected result by the tracing styluses 306F, 306R appears as a small amount, the control unit 50 controls the rotation angular speed Vθn to be increased as the tracing styluses 306F, 306R can easily track the eyeglass lens LE.

In place of using the change in the edge position in the X-axis direction obtained in the measuring process, if the lens curve or the frame curve of the eyeglass lens frame is inputted, using this curve, the change in the edge position in the X-axis direction for the radius vector angle θn can be roughly computed. Thus, the rotation angular speed Vθn may be controlled on the basis of this computed result. The control based on both changes is more preferable.

In this embodiment, the eyeglass lens LE is chucked by the lens chuck axes 102R and 102L so that it is nearly vertical to the setting-up plane on which the processing apparatus body 1 is set up. The refractive surfaces of the eyeglass lens LE are measured by the tracing styluses 306F, 306R located in parallel to the setting-plane. However, the control of the rotation angular speed is not limited to the relationship among these components.

For example, where the eyeglass lens LE is chucked so that its refractive surfaces are in nearly parallel to the setting-up plane of the processing apparatus body and measured by bringing the tracing styluses into contact with the eyeglass lens LE in a direction vertical to the setting-up plane (for example, U.S. Pat. No. 6,099,383 (JP-A-10-225855), the above control of the rotation angular speed can be applied.

Next, an explanation will be given of the operation after the edge position measurement. In the case of the beveling mode, the edge position measurement is carried out at two points of the bevel apex and the bevel bottom (position where the bevel foot and bevel slope cross) in the same longitudinal direction. Once the edge positions of the lens front surface and lens rear surface have been acquired, along a predetermined program, the control unit 50 executes bevel computation of acquiring the bevel path data to be formed on the eyeglass lens LE on the basis of the target lens shape data and edge position information. The computation of acquiring the bevel path data will be described later.

Figure 8:
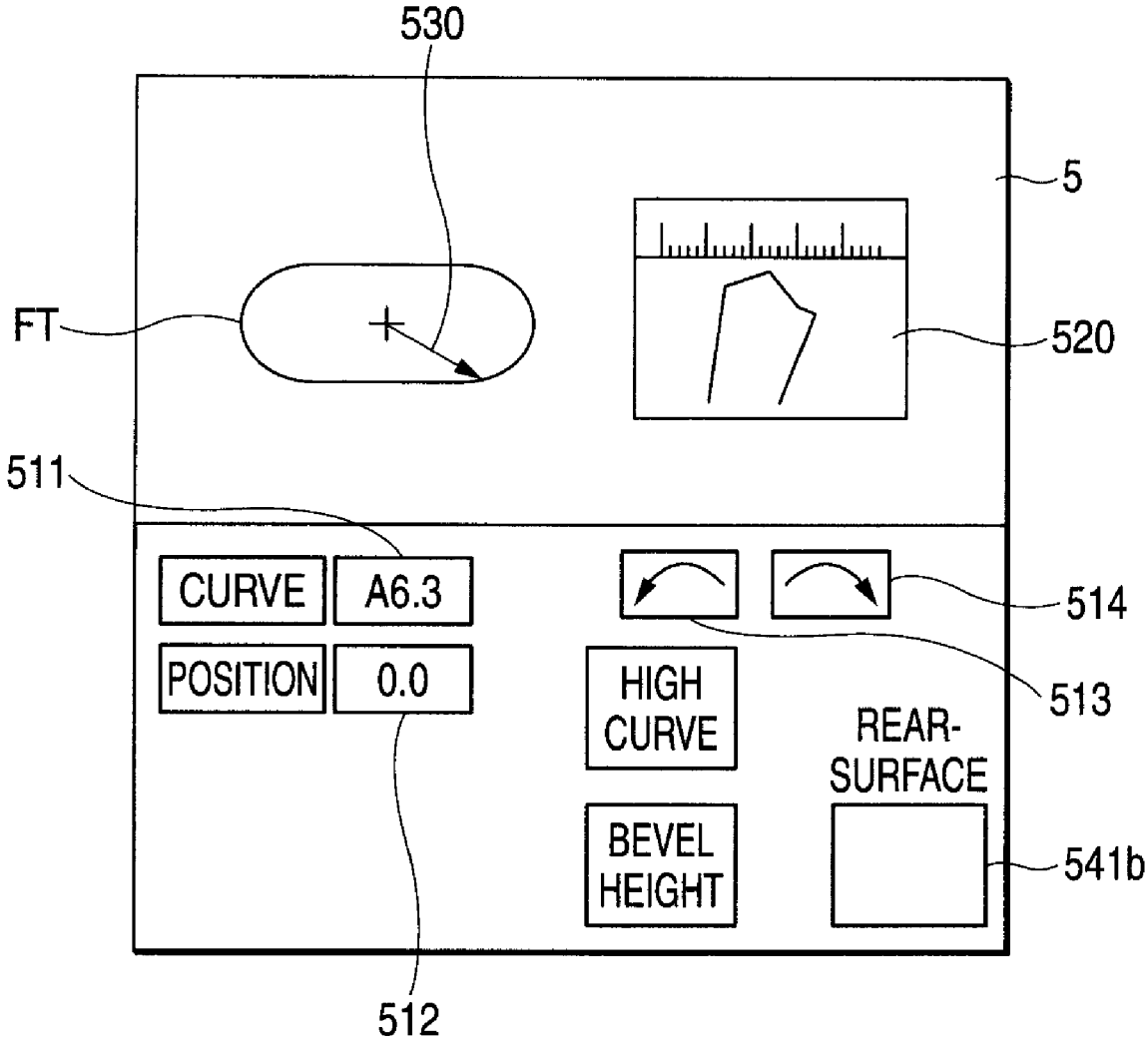
FIG. 8 is a view for explaining a simulation screen of a bevel shape.

Once the bevel computation has completed, a simulation screen permitting the bevel shape to be changed is displayed on the display 5 (see FIG. 8). On the simulation screen, a bevel curve value (Crv) based on the bevel computation is displayed at a display column 511. On the simulation screen, the bevel curve value can be changed. Further, the quantity of moving the bevel apex position in parallel toward the lens front surface or lens rear surface can be inputted at an input column 512. Further, on the simulation screen, the target lens shape FT and a bevel sectional diagram 520 are displayed. By designating the position of a cursor 530 on the target lens shape FT using a button key 513 or 514, the bevel sectional diagram 520 is changed into the state at a designated position.

After the bevel simulation screen has been displayed, when the processing start switch of the switch unit 7 is depressed, the control unit 50 controls the driving of the motors 145, 150, etc, of moving the carriage 101 according to the processing sequence, thereby roughing the peripheral edge of the eyeglass lens LE on the roughing data using the roughing grindstone 166 for plastic. The roughing path of the roughing data is computed as a path of the target lens shape data with a remaining finishing margin.

Now, in the processing of the plastic lens in this embodiment, processing is carried out so that the peripheral edge of the lens LE does not protrude from the grindstone width of the grindstone 166 (hereinafter referred to as "grindstone width effectively using processing") on the way of the roughing.

Figure 9:
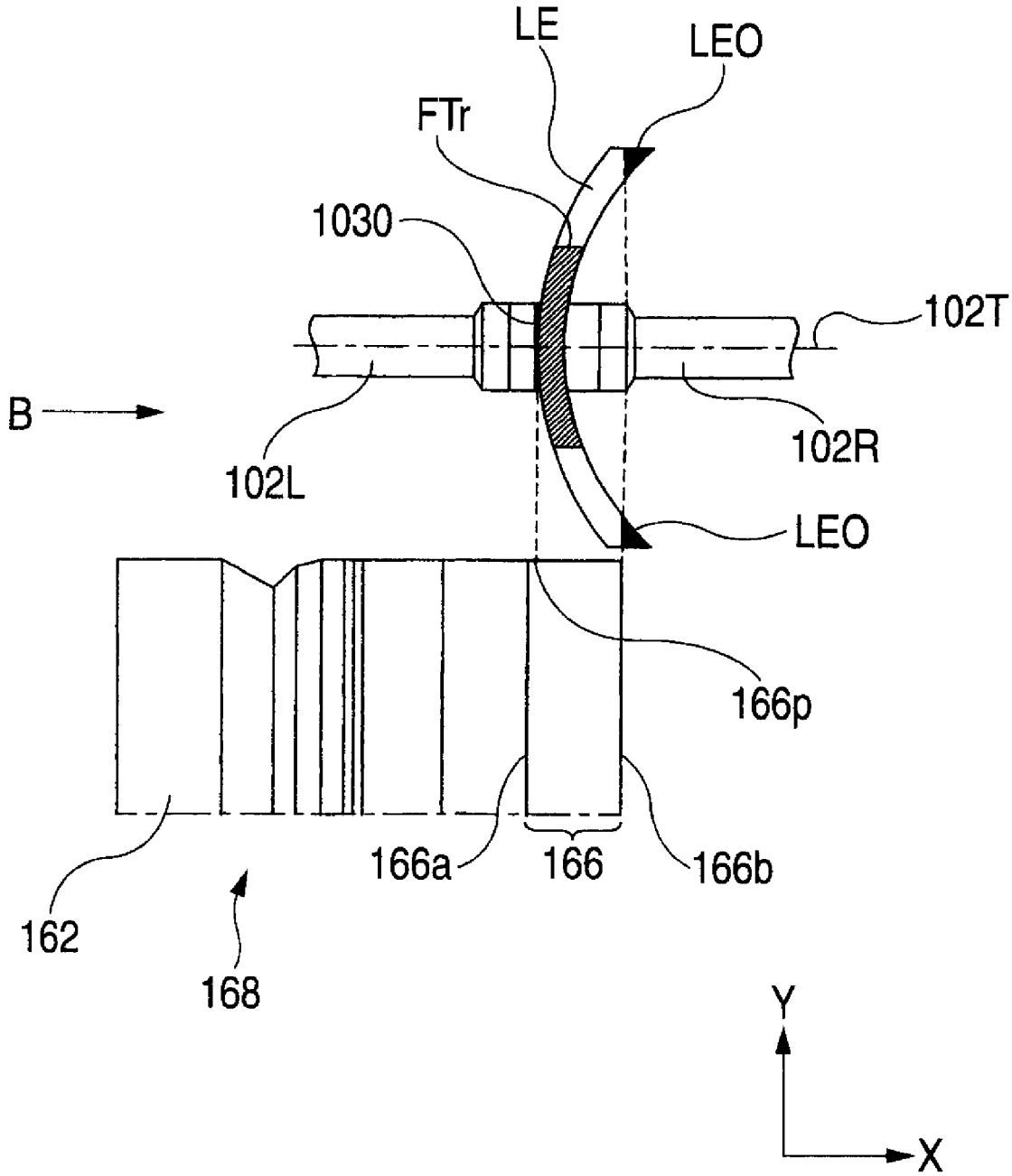
FIG. 9 is a view for explaining the positional relationship between an eyeglass lens and a grindstone group.
Figure 10A:
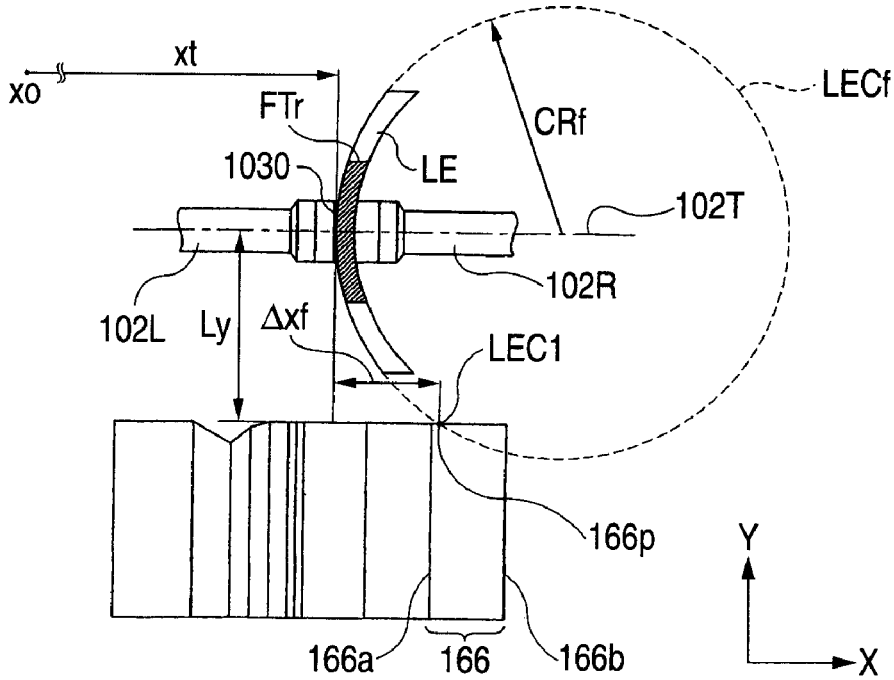
FIGS. 10A to FIG. 10B are second views for explaining the positional relationship between an eyeglass lens and a grindstone group.
Figure 10B:
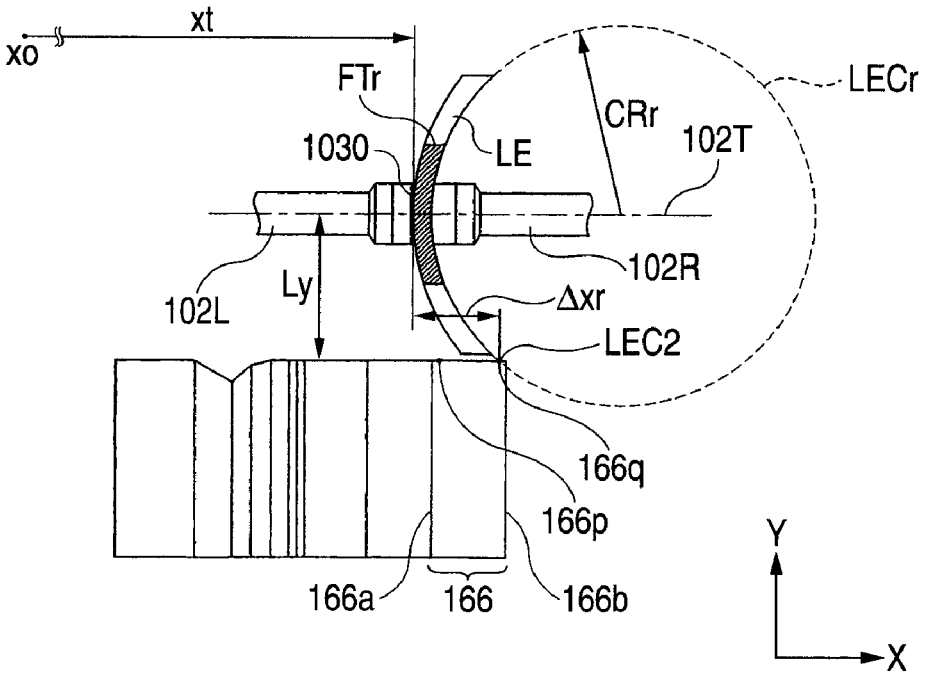

An explanation will be given of the grindstone width effectively using processing. FIG. 9 and FIGS. 10A to 10B are views showing the positional relationship between the high curve lens LE chucked by the lens chuck axes 102R, 102L and grindstone group 168 when seen from the direction of arrow A in FIG. 1. The diagonally shaded area on the eyeglass lens LE is the section of the target lens shape FTr (roughing path) of the eyeglass lens LE to be roughed.

Prior to explaining the grindstone width effectively using processing, the conventional roughing control will be explained briefly. In processing the target lens shape FTr, the control unit 50 drives the motor 145 to move the carriage 101 in the X-direction so that the lens side end 1030 of the lens chuck axis 102L is located at a position 166*p* set inside the left side boundary 166*a* of the roughing grindstone 166 by a predetermined distance (e.g. 2 mm). Thereafter, the control unit 50 drives the motor 150 to change the axis-to-axis distance between the lens chuck axes 102R, 102L and the grindstone spindle 161*a* according to the target lens shape FTr, thereby roughing the peripheral edge of the eyeglass lens LE using the roughing grindstone 166. At this time, in the case of a non-processed high curve lens LE, the outermost area LEO of the eyeglass lens LE protrudes outwardly from the right side boundary 166*b* of the grindstone 166. If the roughing is continued in this state, with the outermost area LEO being left, the remaining area of the eyeglass lens LE will be roughed. With the progress of processing, when the outermost area LEO comes off from the eyeglass lens LE, the eyeglass lens LE may be cracked.

Now it is assumed that the arrangement order of the roughing grindstone 166 and the other grindstones is changed so that the finishing grindstone 164 is arranged on the right side of the roughing grindstone 166 (on the rear side of the eyeglass lens LE). In this case, the outermost area LEO protruded from the right side boundary 166*b* of the roughing grindstone 166 is put on the finishing grindstone 164 so that it is brought into pressure contact with the grindstone 164, thereby increasing the load applied on the eyeglass lens LE. Thus, the axial angle of the actual eyeglass lens LE for the rotation angle of the lens chuck axes 102R, 102L will be changed so that "axis deviation" is likely to occur. Further, this may cause the eyeglass lens LE to be deformed or broken. If the width of the roughing grindstone 166 can be sufficiently increased correspondingly to processing of the high curve lens, the above problem can be solved. However, in addition to the roughing grindstone 166 for plastic and finishing grindstone 164, a plurality of grindstones such as the roughing grindstone 162 for a glass, and high curve bevel finishing grindstone 163 are coaxially attached to the grindstone rotating axis so that the entire width of the grindstones is large. Therefore, if the width of the roughing grindstones 166, 162 is increased, the apparatus must be structured so that the lens chuck axes 102L, 102R can move over the entire grindstone width, and so will be upsized.

In order to obviate such inconvenience, the control unit 50 computes the position in the X-axis direction of the lens front surface and/or the lens rear surface on the basis of the lens front curve and/or lens rear curve and the movement information in the Y-axis direction, and effectively using the narrow grindstone width, performs roughing control so that the edge of the eyeglass lens LE falls within the width of the roughing grindstone 166.

FIGS. 10A to 10B are views for explaining the first method of the grindstone width effectively using processing.

First, the control unit 50 substitutes any four points selected from the edge position on the lens front surface measured by the lens shape measuring portions 300F and 300R for an equation of sphere, thereby acquiring the radius CRf of the lens front surface curve (lens front surface curve is automatically inputted in the control unit 50). In inputting the lens front surface curve data, if the lens front surface curve is previously known (which is obtained through the measurement by a well known curve meter), it may be inputted on the inputting screen of the display 5.

Now, in FIG. 10A, it is assumed that the curve circle with a radius CRf is LECf. It is assumed that the center of the curve circle LECf is located on a rotating center 102T of the lens chuck axes 102R, 102L. It is assumed that the moving distance of the lens side end 1030 of the lens chuck axis 102L for the origin xo in the X-axis direction is xt (movement information in the X-axis direction). It is assumed that the distance in the Y-axis direction from the rotation center 102T to the roughing grindstone 166 is Ly, and the point on the curve circle LECf apart by the distance Ly from the rotation center 102T is LEC1. Further, it is assumed that the distance in the X-axis direction from the point LEC1 on the curve circle LECf to the lens side end 1030 is Δxf. The distance Δxf is acquired from the radius CRf of the curve circle LECf of the lens front surface and the distance Ly. The control unit 50 computes the distance xt on the basis of the position 166*p* relative to the origin xo and the distance Δxf so that the point LEC1 on the curve circle LECf corresponding to the distance Ly in the Y-axis direction is always located on the position 166*p* on the roughing grindstone 166.

In roughing, the control unit 50 controls the movement in the Y-axis direction of the eyeglass lens LE on the basis of the target lens shape FTr, and also controls the movement in the X-axis direction of the eyeglass lens LE on the basis of the distance xt corresponding to the distance Ly. At this time, the lens side end 1030 is moved on a moving path along the curve circle LECf of the lens front surface. Thus, the eyeglass lens LE is moved so that the lens front surface always lies at the position 166*p*. Therefore, the front surface of the eyeglass lens LE does not protrude from the left side boundary 166*a* and the rear surface of the eyeglass lens LE also does not protrude from the right side boundary 166*b* because the width of the roughing grindstone 166 is wider than the edge of the eyeglass lens LE. In such a state, the edge of the eyeglass lens LE is roughed.

As described above, if the curve circle LECf of the lens front surface is caused to always lie on the predetermined position 166*p* on the roughing grindstone 166, even the high curve lens can roughed without the lens rear surface position protruding from the width of the roughing grindstone 166. Even where the width w166 of the roughing grindstone 166 is narrow, this grindstone width can be effectively used.

The above roughing control was carried out with reference to the lens front side. Under the same idea, as shown in FIG. 10B, the roughing control with reference to the lens rear side can also be adopted. In this case, the control unit 50 acquires the curve circle LECr from the rear surface curve radius CRr of the eyeglass lens LE. The control unit 50 computes the distance xt on the basis of the position 166*q* relative to the origin xo and the distance Δxr so that the point LEC2 on the curve circle LECr corresponding to the distance Ly in the Y-axis direction is always located on a predetermined position 166*q* (predetermined position on the lens rear side) set inside by a predetermined distance (2 mm) from the right side end surface 166*b* of the roughing grindstone 166. The control unit 50, on the basis of the computed result, controls the movement in the Y-axis direction of the eyeglass lens LE and also controls the movement in the X-axis direction thereof. Although the rear surface curve radius CRr acquired through the measurement of the edge position of the lens rear surface is supplied to the control unit 50, the measurement result of the lens rear surface curve previously made may be supplied thereto.

Further, the edge of the eyeglass lens LE is set within the width of the roughing grindstone 166 using both input data of the front surface curve radius CRf and the rear surface curve CRr, and then the movement information in the X-axis direction relative to the movement in the Y-axis direction may be acquired. In this case, for example, by acquiring the curve circle located at the middle between the front surface curve radius CRf and the rear surface curve radius CRr is acquired, and using the movement information in the X-direction computed so that the curve circle acquired lies on the center position of the width of the roughing grindstone 166, the roughing is performed. Further, from when the distance in the X-direction between the curve circle LECf and LECr becomes shorter than the width of the roughing grindstone 166, the movement in the X-axis direction may be determined within a range in which the point where the curve circle LECf of the lens front surface is brought in contact with the roughing grindstone 166 is located inside the position 166*p* and the point where the curve circle LECr of the lens rear surface is brought in contact with the roughing grindstone 166 is located inside the position 166*q*.

In order to reduce partial abrasion of the grindstone surface of the roughing grindstone 166, the X-axis movement is preferably controlled so that the edge of the eyeglass lens LE is roughed equally using the surface of the roughing grindstone 166 within a range where both of the curve circle LECf of the lens front surface and the curve circle LECr of the lens rear surface fall within the width of the roughing grindstone (between the position 166*p* and the position 166*q*).

The trouble caused when roughing only in the Y-axis direction movement is likely to occur when the eyeglass lens LE has a higher curve. Thus, where the eyeglass lens LE is a high curve lens (for example, the lens curve is 6 or more curve), the above grindstone width effectively using processing may be carried out; and where the curve of the eyeglass lens LE is not so high, like before, the roughing by only the Y-direction movement may be carried out. However, if it is desired that the width of the roughing grindstone 166 is not wide and the processing apparatus body 1 has a compact structure, even if the eyeglass lens LE does not have a high curve, the above grindstone width effectively using processing is preferably adopted.

Meanwhile, the method explained referring to FIGS. 10A to 10B can be also applied to the case where the outer size of the eyeglass lens LE before processing is not known. In many cases, the eyeglass lens LE is moved simultaneously in both Y-axis direction and X-direction. Thus, in these cases, the load applied on the eyeglass lens LE may become slightly larger than in the case of the movement in only the Y-axis direction. In order to reduce such load, an explanation will be given of the second roughing method of using the grindstone effectively using processing in which the eyeglass lens LE is moved in the X-axis direction only when the edge of the eyeglass lens LE protrudes from the width of the roughing grindstone 166.

Figure 11A:
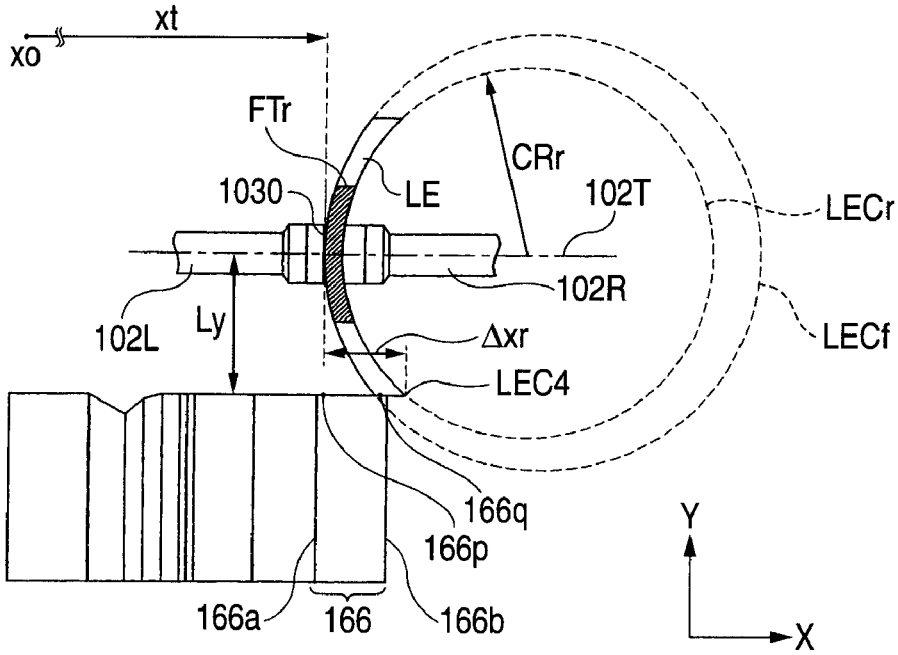
FIGS. 11A to 11B are views for explaining acquisition of the outer shape size before lens processing.
Figure 11B:
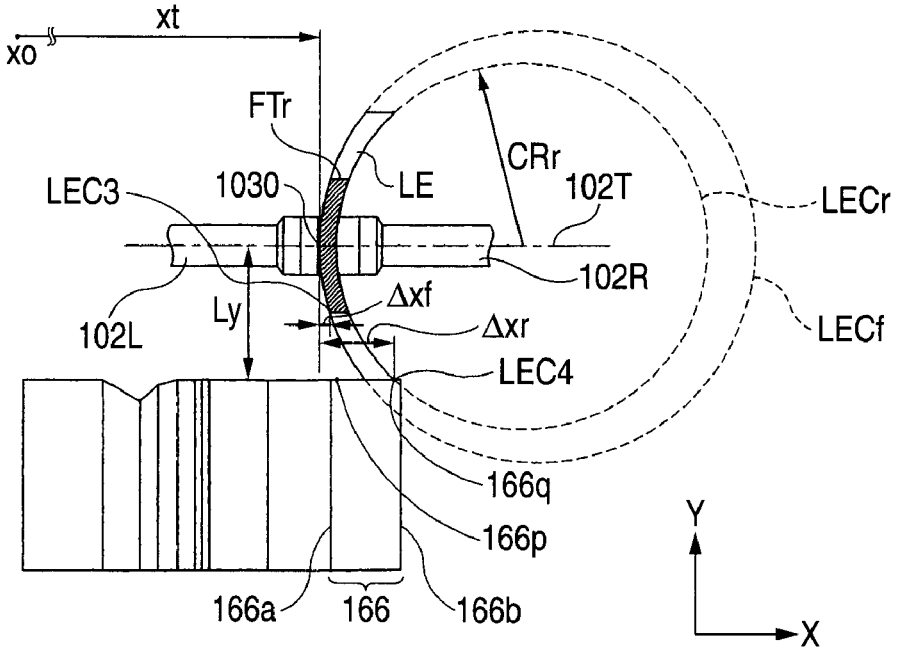
Figure 12:
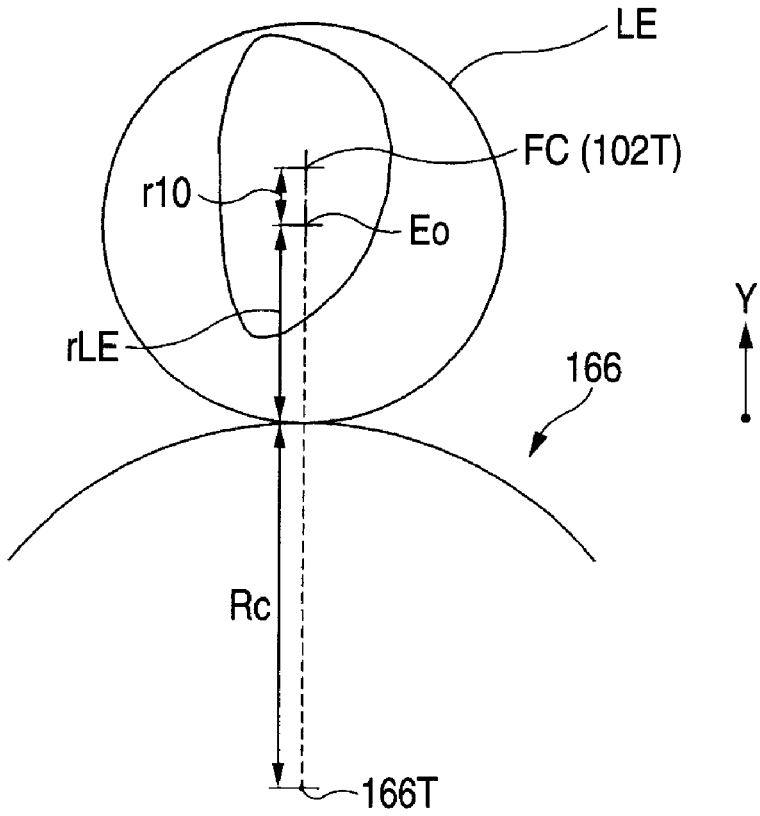
FIG. 12 is a second view for explaining acquisition of the outer shape size before lens processing.

First, in order to know the edge thickness of the eyeglass lens LE before processing, the outer size of the eyeglass lens LE (material lens) before processing will be acquired as follows. In starting the roughing, as shown in FIGS. 11A to 11B, the control unit 50 drives the motor 145 to move the lens chuck axis 102L in the X-axis direction so that the lens side end 1030 is located at the position 166*p* of the roughing grindstone 166. Further, the control unit 50, as shown in FIG. 12, drive the motor 120 to rotate the eyeglass lens LE so that the geometrical center FC of the target lens shape, the optical center Eo of the eyeglass lens LE and the center 166T of the roughing grindstone 166 are located on the same straight line. In the case of an optical center chuck in which the optical center Eo of the eyeglass lens LE agrees with the rotation center 102T, it is not necessary to consider the geometrical center FC. In this case, without rotating the eyeglass lens LE, the control unit 50 drives the motor 150 to move the lens chuck axes 102L, 102R in the Y-axis direction so that the eyeglass lens LE is brought into contact with the roughing grindstone 166. At this time, the control unit 50 compares the driving pulse signal of the motor 150 with the pulse signal outputted from the encoder 158 and, when a deviation between both signals is generated, detects that the eyeglass lens LE has been brought into contact with the roughing grindstone 166. This is because owing to the reaction force applied from the grindstone 166 when the eyeglass lens LE is brought into contact with the grindstone 166, the quantity of movement of the actual eyeglass lens LE becomes smaller relatively to the quantity of movement of the eyeglass lens LE converted from the driving signal of the motor 150.

Further, by detecting a change in the driving current of the motor 160 rotating the grindstone (when the eyeglass lens LE is brought into contact with the grindstone 166, owing to the reaction force applied from the eyeglass lens LE to the grindstone 166, a current quantity of the motor 160 changes), it can be also detected that the eyeglass lens LE has been brought in contact with the grindstone 166. Similarly, it can be also detected from a change in the driving current of the motor 150 for the Y-axis movement that the eyeglass lens LE has been brought in contact with the grindstone 166. By using both deviation in the Y-axis direction and changes in the current quantity of the motor 160, the reliability of detecting that the eyeglass lens LE has been brought into contact with the grindstone 166 can be enhanced.

At this time, as the case may be, the outer periphery of the eyeglass lens LE may protrude from the grindstone 166. How, because of a very short time, the influence such as axis deviation is negligible.

When it is detected that the eyeglass lens LE has been brought into contact with the roughing grindstone 166, the control unit 50 can acquire the Y-axis position of the rotation center 102T at this time from the encoder 158 to compute the radius rLE of the eyeglass lens LE before processing on the basis of the radius Rc of the roughing grindstone 166 and the layout data (distant r10) of the optical center Eo relative to the geometrical center FC.

Further, as shown in FIG. 11A, the control unit 50 previously computes the curve circle LECf of the lens front surface and the curve circle LECr of the lens rear surface by inputting curve data. The control unit 50 acquires the distance Ly between the rotation center 102T and the lens outer periphery from the radius rLE of the eyeglass lens LE. On the basis of the distance Ly and the curve circle LECr of the lens rear surface, the control unit 50 acquires the distance Δxr from the lens side end 1030 to the point LEC4 of the lens rear surface (on the curve circle LECr) when the eyeglass lens LE is brought into contact with the grindstone 166. If the distance Δxr is known, it can be decided whether or not the edge point LEC4 of the lens rear surface protrudes from the predetermined position 166*q* of the lens rear side of the roughing grindstone 166, and the distance from the predetermined position 166*q* to the point LEC4 can be also computed.

At this time, if the lens rear surface (edge point LEC4) does not protrude from the predetermined position 166*q* of the roughing grindstone 166, like the conventional manner, while the eyeglass lens LE is being rotated, the roughing is carried out by the movement control in only the Y-axis direction on the basis of the target lens shape data. If the lens rear surface (edge point LEC4) protrudes from the predetermined position 166*q* of the roughing grindstone 166, the lens chuck axis 102L is moved toward the left side (lens front side) by the protruding quantity and thereafter the roughing is started (see FIG. 11B).

Further, the control unit 50 computes the distance Δxf from the lens side end 1030 to the lens front surface (curve circle LECf) according to the distance Ly (movement information in the Y-axis direction) to be changed in the Y-axis direction. When the distance Ly in the Y-axis direction is shortened with the progress of the roughing, the control unit 50 acquires, from the distance Δxf, the position of the lens front surface of the curve circle LECf relative to the predetermined position 166*p* of the lens front side of the roughing grindstone 166. Before the lens front surface outwardly protrudes from the predetermined position 166*p* of the roughing grindstone 166, the eyeglass lens LE is moved toward the rear side. Its moving position is set within the range in which the lens rear surface acquired from the curve circle LECr does not protrude from the predetermined position 166*q* of the roughing grindstone 166. The lens side end 1030 or the lens front surface position LEC3 of the curve circle LECf acquired from the target lens shape for roughing has only to be moved to the position 166*p* of the roughing grindstone 166. Thereafter, without moving the eyeglass lens LE in the X-direction, the roughing can be carried out.

By the roughing control described above, even with the high curve lens, effectively using the grindstone width of the roughing grindstone with a narrow width, the roughing can be carried out without the lens protruding from the roughing grindstone 166. Further, according to the roughing technique illustrated in FIGS. 11A to 11B, the movement in the X-axis direction during the roughing can be reduced so that the redundant load applied on the eyeglass lens LE during the roughing can be reduced.

Figure 13:
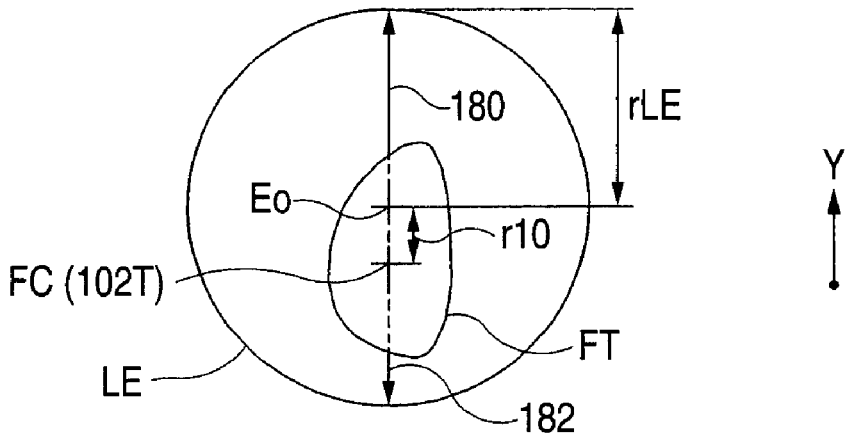
FIG. 13 is a third view for explaining acquisition of the outer shape size before lens processing.

As device for acquiring the outer size of the eyeglass lens LE before processing, the lens edge position measuring portions 300F, 300R can be also employed. The control unit 50, as shown in FIG. 13, after the direction of a straight line 180 connecting the optical center Eo and the geometrical center FC (rotation center 102T) is caused to agree with the Y-axis direction by the rotation of the eyeglass lens LE, brings at least one of the tracing stylus 306F and 306R of the eyeglass lens shape measuring portion 300F into contact with the target lens shape FT. Thereafter, the control unit 50 controls the Y-axis movement of the eyeglass lens LE so that the tracing stylus 306F (or 306R) moves outwardly of the target lens shape FT along the straight line 180. When the tracing stylus 306F (or 306R) deviates from the state where it is in contact with the refractive surface of the eyeglass lens LE, the detection information of the edge position of the encoder 313F (or 313R) abruptly changes. By acquiring the moving position in the Y-axis direction from the encoder 158, the radius rLE which is the outer size of the eyeglass lens LE before processing can be computed. Further, if the outer size of the eyeglass lens LE before processing is known beforehand, the operator may input the radius rLE on a predetermined screen of the display 5. With respect to the optical center Eo, along the direction of a straight line 182 with an orientation opposite to that of the straight line 180, the tracing stylus 306F or 306R may be moved.

The explanation has been hitherto given of the grindstone effectively using processing. This processing should not be limited to the manner as described above. As long as the relative movement between the grindstone and the eyeglass lens LE is controlled on the basis of the refractive surface information (at least one curve data on the lens front surface and lens rear surface) in order that when the eyeglass lens LE is roughed by a predetermined grindstone, it does not protrude from the roughing grindstone, such control is included in the technical idea of the grindstone effectively using processing.

Next, an explanation will be given of the bevel-finishing after the roughing. As described above, in the beveling mode, according to the curve of the eyeglass lens LE to be fitted in the eyeglass lens frame, the high curve mode or the low curve mode being the normal processing mode can be selected by the button key 501 of the display 5.

When the low curve mode is selected, the beveling by the finishing grindstone 164 with the V-groove is set and the bevel path data are computed by the control unit 50. On the basis of the edge position data of the lens front surface and lens rear surface by the lens edge position measurement and the target lens shape, the bevel path data are computed from a predetermined computing equation so that the bevel apex is located between the lens front surface and the lens rear surface. For example, it is computed as the path on which the bevel apex is located on the entire periphery to divide the edge thickness at a predetermined ratio (e.g. 3:7) and also the path shifted toward the lens rear side by the bevel curve along the lens front surface curve. The computing of the bevel path data can be realized by the method disclosed in JP-A-2-212059. The beveling by the finishing grindstone 164 with the V-groove will not explained here because it is described in JP-A-2-212059 and others.

Figure 14:
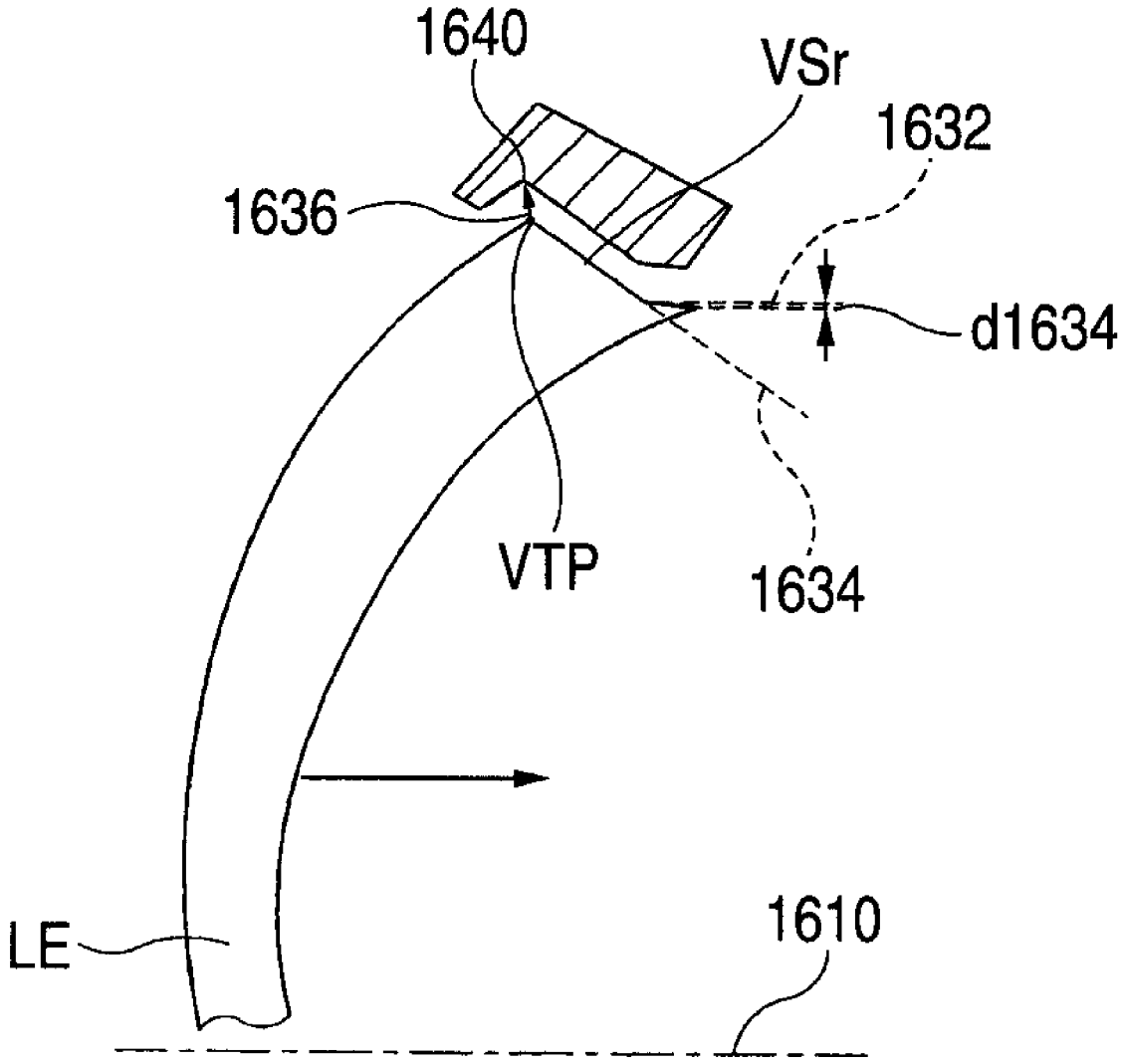
FIG. 14 is a view for explaining formation of a bevel of a high curve lens.

Next, an explanation will be given of the computing of the bevel path data in the case of the high curve mode (high curve lens). In the case of the high curve mode, the bevel apex path is computed so that it basically runs along the lens front surface curve. The bevel formed when the eyeglass lens LE is fitted in a high curve frame MFR, in order to give the good appearance, as shown in FIG. 14, is set so that if the edge thickness of the eyeglass lens LE is not larger than a predetermined value t0 (e.g. 3 mm), the bevel apex VTP is located on the front surface curve and a bevel slope Vsr is formed on only the lens rear side. The reasons are as follows. Namely, because the high curve lens conforming to the frame curve (the eyeglass lens LE having a steep lens front surface curve) is employed as the eyeglass lens LE fitted in the high curve frame MFR, the lens front surface can be sufficiently served as the front side bevel slope. Further, if the front side bevel slope with an angle different from that of the lens front surface is formed largely, the boundary line therebetween is conspicuous due to the difference in the angle so that the appearance is deteriorated. If the edge thickness is larger than the predetermined value t0, setting is made so that the bevel apex VTP is shifted toward the lens rear side according to the edge thickness. Further, on the lens front side, a small plane may be formed as a kind of chamfering by using the front surface beveling grindstone. In this case, the bevel apex is shifted toward the lens rear side.

It is assumed that the bevel apex path data are represented by (rn, θn, Hn) (n=1, 2, . . . , N) where rn is the radius vector of the target lens shape data, θn is the data of the radius vector angle and Hn is the position data in the X-axis direction. In the setting in which the bevel slope VSr is formed on only the lens rear side, as the position data in the X-axis direction, the edge position data of the lens front surface detected by the lens edge position measuring portion 300F is employed as it is.

Next, referring to FIG. 15A, an explanation will be given to the method of acquiring the rear surface beveling data for forming a bevel slope VSr on the lens rear side using a rear surface beveling slope 163Rs on the basis of the bevel apex path data (rn, θn, Hn).

Figure 15A:
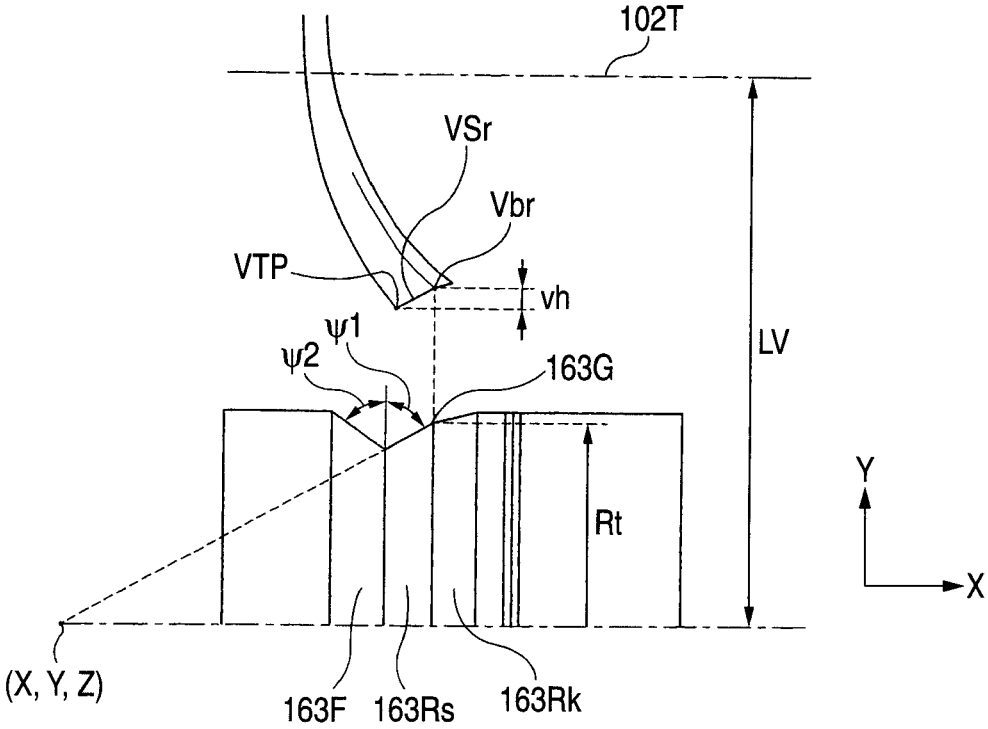
FIGS. 15A to 15B are views for explaining the manner for acquiring beveling data.

In FIG. 15A, a bevel height vh (distance in the Y-axis direction from the bevel bottom Vbr where the bevel slope VSr and the bevel foot cross each other to the bevel apex VTP) is previously set. The bevel height vh can be called up from the memory 51 previously storing it by the control unit 50 and also can be arbitrarily set on the display 5. The control unit 50 acquires a processing point of assuring the bevel bottom Vbr having the bevel height vh thus set.

It is assumed that the grindstone radius at the crossing point 163G on the grindstone 163 to be brought into contact with the bevel bottom Vbr is Rt. The axis-to-axis distance LV (distance between the lens rotation center 102T and grindstone rotation center) when the processing is performed with the diameter smaller by the bevel height vh than the two dimensional target lens shape data (rn, θn) of the bevel apex path data (rn, θn, Hn) (n=1, 2, 3, . . . , N) is acquired from $$LV=rn\cdot\cos\theta n+\sqrt{(Rt-vh)^2-(rn\cdot\sin\theta n)^2} \qquad \text{Equation 1}$$

(n=1, 2, 3, . . . , N)

The same computation as Equation 1 is carried out with the target lens shape data (rn, θn) rotated by any minute angle around the lens rotation center. The rotating angle ξi (i=1, 2, 3, . . . , N) at this time is computed on the entire periphery. By acquiring the maximum value LVi of the distance LV at each rotating angle ξi, the reference processing data (LVi, ξi) of the processing point for assuring the bevel bottom Vbr at each lens rotating angle ξi can be obtained.

Next, according to the reference processing data (LVi, ξi), the processing point in the X-axis direction is acquired so that the bevel apex is tangent to the rear surface beveling slope 163Rs. Now, for brevity of explanation, when considered as an orthogonal coordinate system relatively having an origin of the lens chuck axes 102R, 102L, the bevel apex path data (rn, θn, Hn) are replaced by bevel apex path data (xn, yn, zn) where the (rn, θn, Hn) is expressed by:

$$xn=rn\cdot\cos\theta n$$

$$yn=rn\cdot\sin\theta n$$

$$zn=zn \qquad \text{Equation 2}$$

(n=1, 2, 3, . . . , N)

At this time, the grindstone of the rear surface beveling slope 163Rs having the same origin as that of the orthogonal coordinate system can be expressed by $$(x-X)^2+(y-Y)^2=(z-Z)^2\cdot\tan^2\psi 1 \qquad \text{Equation 3}$$

The (X, Y, Z) in Equation 3 is placed on a virtual cone apex coordinate constituting the grindstone plane of the rear surface beveling slope 163Rs. Z in the rear surface beveling slope 163Rs side is expressed by $$Z=z+\sqrt{\frac{(x-X)^2+(y-Y)^2}{\tan^2\psi 1}} \qquad \text{Equation 4}$$

Further, on the orthogonal coordinate system in which ξi in the above reference processing path replaced by θn, Xn and Yn are expressed by $$Xn=LV\cdot\cos\theta n$$

$$Yn=LV\cdot\sin\theta n \qquad \text{Equation 5}$$

(n=1, 2, 3, . . . , N)

By using these values and substituting the bevel apex path data (xn, yn, zn) into Equation 2, the maximum value of Z Zmax is acquired. The same computation is performed while rotating the bevel apex path data (xn, yn, zn) by any optional angle ξi (i=1, 2, 3, . . . N) around the lens rotation center over the entire periphery thereby to acquire the maximum value Zmax i of Z at each ξi. Thus, the processing point where the bevel apex is tangent to the rear surface beveling slope 163Rs is acquired. The Zmax i acquired and the above reference processing data (LVi, ξi) provides the rear surface beveling data of (LVi, Zmax i, ξi) (i=1, 2, 3, . . . N).

During the beveling, for each lens rotation angle ξi of the above rear surface beveling data, the control unit 50 controls the Y-axis movement of the carriage 101 on the basis of the data LVi and also controls the X-axis movement of the carriage 101 on the basis of Zmax i. Thus, the bevel slope VSr is formed on only the lens rear side. In this case, without simultaneously processing the bevel slope on the lens front side, only the bevel slope on the lens rear side is processed individually. Thus, even with the high curve bevel, the problem of bevel thinning due to the interference can be solved. In order to avoid that the bevel apex gives an acute angle, before or after the beveling due to the rear surface beveling slope

163Rs, control is preferably done so that the bevel apex area is flat-finished with a predetermined width of e.g. 0.1 mm by the flat-finishing grindstone plane of the finishing grindstone 164.

In the case of the high curve lens also, the bevel foot is preferably formed by the processing slope 163Rk. The reason therefor will be explained referring to FIG. 14. Where the lens LE has the high curve, if the angle of the rear surface bevel foot processing slope 163Rk of the grindstone 163 relative to a reference line 1610 is 0°, the bevel foot formed on the rear surface of the eyeglass lens LE is in parallel to the reference line 1610 like a dotted line 1632. In this case, the dotted line 1632 indicative of the bevel foot and the frame MFR interfere with each other so that the fitness when the eyeglass lens LE is fitted in the frame MFR is not pleasant. Inversely, where the grindstone 163 does not have the rear surface bevel foot processing slope 163Rk so that the bevel slope is evenly formed at the angle of the rear surface beveling slope 163Rs from the bevel apex VTP of the eyeglass lens LE to the rear surface of the eyeglass lens LE, the slope is formed like dotted line 1634 and so the bevel foot is not formed (only the bevel slope is formed from the bevel apex VTP to the rear surface of the eyeglass lens LE). In this case, if the eyeglass lens LE is fitted in the frame MFR from the direction of arrow 1636, a large gap d1634 will be formed between the edge of the rear surface of the eyeglass lens LE and the frame MFR so that the appearance when framed is not pleasant. For this reason, where the bevel slope is formed on the rear side of the eyeglass lens LE with the high curve, as in this embodiment, the slope 163Rk for forming the bevel foot is preferably provided at an angle relative to the reference line 1610 smaller than the angle of the rear surface beveling slope 163Rs relative to the reference line 1610.

In the case of the eyeglass lens LE with the high curve, without the bevel being formed on the lens front side, the lens front surface, because of the front surface beveling slope 163F, is fitted with sufficient catch for the front surface 1640 of the groove of the frame MFR. Therefore, if the edge thickness of the eyeglass lens LE measured by the lens edge position measuring portions 300F, 300R is small, the bevel on the lens front side is not required. Thus, even with the high curve lens, the beveling providing the good appearance can be done without lengthening the processing time as compared with the processing time of the ordinary beveling using the finishing grindstone 164.

Figure 16A:
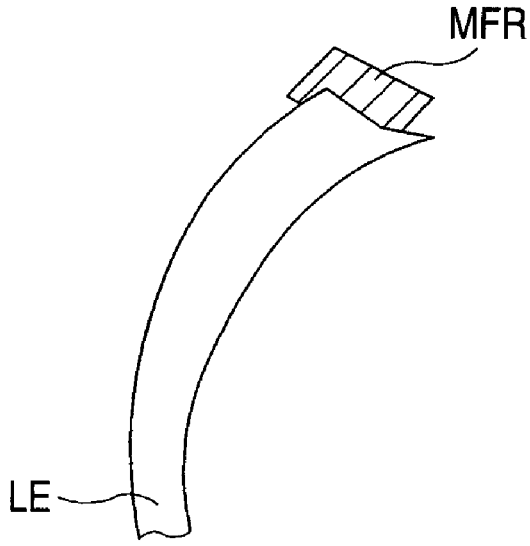
FIGS. 16A to 16B are views for explaining the bevel on the front side.

However, where the edge thickness of the eyeglass lens LE is large (for example, 3 mm or more), the bevel slope is preferably formed also on the lens front side. FIG. 16A shows the case where the eyeglass lens LE with a large edge thickness is fitted in the frame MFR without the bevel being on the lens front side. As seen, when the eyeglass lens LE is fitted in the frame MFR, the eyeglass lens LE protrudes from the rear side of the frame MFR so that the appearance after fitting when seen laterally is not pleasant.

Figure 16B:
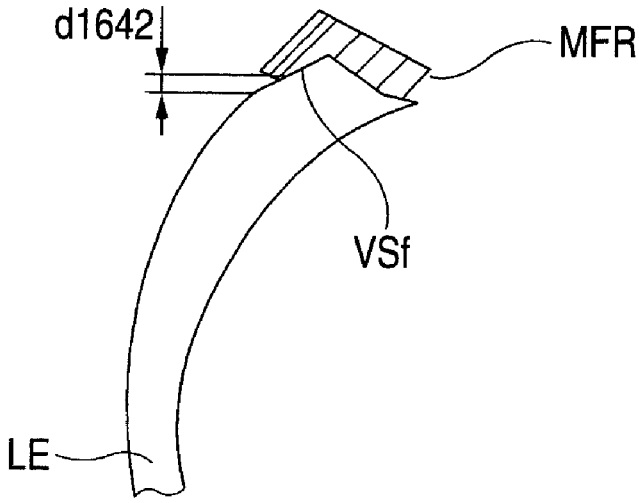

On the other hand, FIG. 16B shows the case where after the bevel slope VSf is formed with the front surface beveling slope 163F on the lens front side of the same eyeglass lens LE as shown in FIG. 16A, the eyeglass lens LE is fitted in the frame MFR. As seen from FIG. 16B, unlike the case of FIG. 16A, the eyeglass lens LE does not protrude from the frame MFR, and the eyeglass lens LE can be fitted therein with the good appearance seen laterally.

From the point of view of safety of an eyeglass lens wearer, it is not preferred that the eyeglass lens LE comes off the frame MFR in the direction of arrow 1650 (toward the rear side) (see FIG. 14). In view of this, in order to assure the catch for the frame MFR (difficulty of come off after fitting), the inclination angle of the rear surface processing slope 163Rs relative to the reference line 1610 is made larger than that of the front side bevel formed by the front surface beveling slope 163F. Moreover, a smaller quantity of the bevel revealing area d1642 not covered with the frame MFR in the front side bevel slope VSf is preferable from the viewpoint of appearance (if the angle of the front surface beveling slope 163F relative to the reference line 1610 is excessively large, it is not preferable from the viewpoint of appearance). In view of these facts, in this embodiment, the front surface beveling slope 163F is formed in the direction of the angle of 30° relative to the reference line 1610, and the rear surface beveling slope 163Rs is formed in the direction of the angle of 45° relative to the reference line 1610. It should be noted that these angles are exemplary.

Figure 15B:
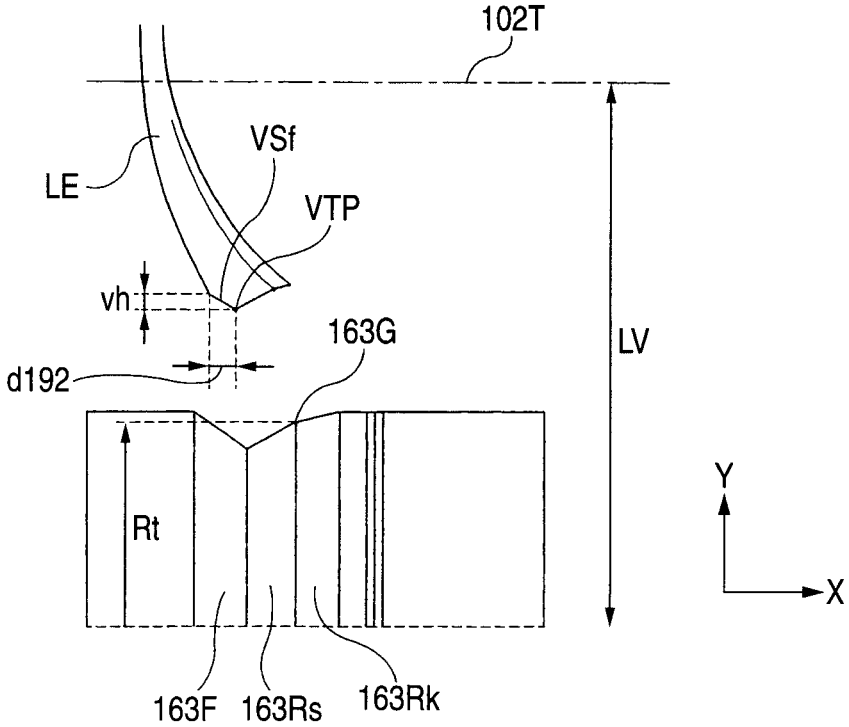

An explanation will be given of the case where the bevel slope is formed on the lens front surface (see FIG. 15B). If the thickest area in the edge thicknesses measured by the edge position measuring portions 300F, 300R is not smaller than a predetermined value t0 (3 mm), the control unit 50 makes setting of forming the bevel slope on the lens front side also. At this time, the control unit 50, if the thickest area is within a range not smaller than 3 mm but smaller than 4 mm, computes the bevel path so that the distance d192 from the front side of the eyeglass lens LE to the bevel apex VTP is 0.3 mm. The distance d192 is shifted so that the distance d192 is increased by 0.1 mm whenever the thickest area increases by 1 mm in such a fashion that if the thickest area is within a range not smaller than 4 mm but smaller than 5 mm, the distance d192 is set at 0.4 mm; if the thickest area is within a range not smaller than 5 mm but smaller than 6 mm, the distance d192 is set at 0.5 mm, . . . . By setting the distance d192, the bevel height vh at this time can be acquired from the 163$\alpha f$ ($\psi$2 in FIG. 15A) of the front beveling slope 163F.

In beveling the eyeglass lens front surface, it is assumed that the intersecting point of the lens front surface and the bevel slope lies on the position of the same grindstone radius Rt position as in the case of the lens rear surface. Where the bevel slope is formed on the lens front surface of the high curve lens, the presence of the bevel foot on the lens front surface is not preferable from the viewpoint of appearance so that the bevel foot will not be formed. Therefore, in computing the front surface beveling data, by replacing Equation 3 by $$(x-X)^2+(y-Y)^2=(z-Z)^2\cdot\tan^2\psi 2 \qquad \text{Equation 6}$$

and replacing Equation 4 by $$Z = z - \sqrt{\frac{(x-X)^2+(y-Y)^2}{\tan^2\psi 2}} \qquad \text{Equation 7}$$

in the same manner as in the case of the lens rear surface, the front surface beveling data (LVi, Zmax i, $\xi$) (i=1, 2, 3, . . . , N) can be acquired.

For each lens rotation angle $\xi$i of the above front surface beveling data, the control unit 50 controls the Y-axis movement of the carriage 101 on the basis of the data LVi and also controls the X-axis movement of the carriage 101 on the basis of the data Zmax i so that even with the high curve bevel where the bevel slope VSf is formed on the lens front side by this, the problem of bevel thinning due to the interference can be solved.

Hitherto, the setting of the bevel based on the edge thickness of the eyeglass lens LE has been explained, but the setting of the bevel is not limited to the manner as described above. Further, whether or not the front side bevel should be formed is determined with reference to 3 mm of the thickest area. However, this reference should not be limited to 3 mm. Whether or not the front surface bevel should be formed may be selectable by the operator. In this case, the bevel apex position may be changeable on the simulation screen displayed on the display 5 shown in FIG. 8 by the button key 512.

It is convenient that the bevel height vh of the rear surface described above is set according to the kind of the eyeglass lens frame. In the lens peripheral edge processing, as described referring to FIG. 4, the operator selects the kind of the eyeglass lens frame in a state where the target lens shape FT is displayed on the screen 500 of the display 5. Where metal is selected as the material of the eyeglass lens frame, the bevel height vh is set at 2 mm by the control unit 50. Where "cell" is selected as the material of the eyeglass lens frame, the bevel height vh is set at 3.5 mm by the control unit 50. Further, as shown in FIG. 8, the height of the rear surface bevel height can be changed by manipulating a button 541*b* displayed on the display 5.

In this way, by the processing with the bevel height of the lens rear surface changed according to the inputted material of the eyeglass lens frame, the appearance when the eyeglass lens LE is fitted in the eyeglass lens frame can be improved.

Figure 17:
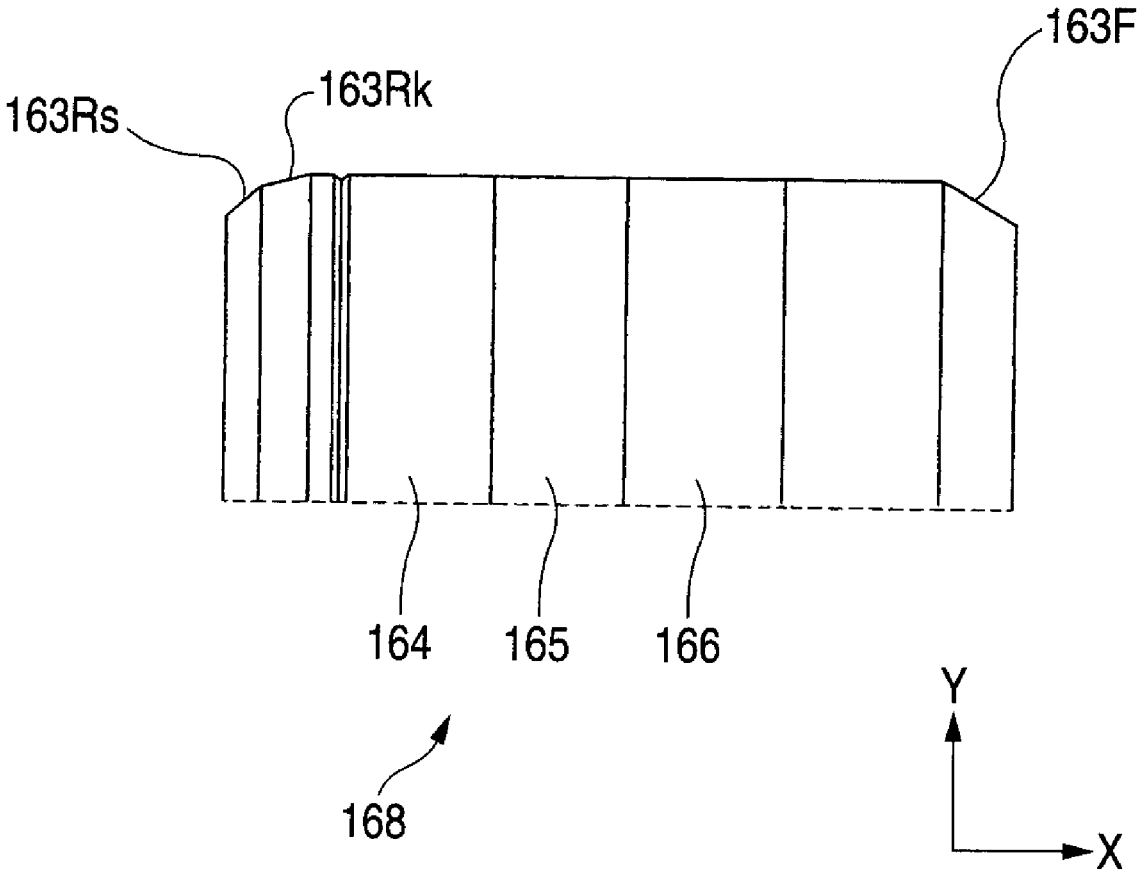
FIG. 17 is a view for explaining another construction of a grindstone group.

Further, the high curve beveling grindstone 163 includes the front surface beveling slope 163F and the rear surface beveling slope 163Rs adjacent to each other, but should not be limited to such structure. As shown in FIG. 17, at the one of both ends of the grindstone group 168, the front surface beveling slope 163F may be arranged, whereas at the other thereof, the rear surface beveling slope 163Rs and the rear surface bevel foot processing slope 163Rk may be arranged. In the arrangement of the grindstones as shown in FIG. 3, the vicinity of the boundary between the front surface beveling slope 163F and the rear surface beveling slope 163Rs cannot be employed for actual processing. However, in the structure as shown in FIG. 17, the entity of the front surface beveling slope 163F and the rear surface beveling slope 163Rs can be employed for processing.

What is claimed is:

1. An eyeglass lens processing apparatus for beveling a peripheral edge of an eyeglass lens, comprising:

a pair of lens chuck shafts which hold the eyeglass lens;

a V-groove beveling grindstone which simultaneously processes bevel slopes on front and rear sides of the eyeglass lens;

a front beveling grindstone and a rear beveling grindstone which individually process the bevel slopes on the front and rear sides, respectively, wherein a width of each of a front beveling slope of the front beveling grindstone and a rear beveling slope of the rear beveling grindstone is larger than a width of each of a front beveling slope and a rear beveling slope of the V-groove beveling grindstone;

a lens edge position detector for detecting edge positions of a front surface and a rear surface of the eyeglass lens on the basis of target lens shape data;

a mode selector which selects one of a low curve lens processing mode and a high curve processing mode;

a computing unit which:

acquires, if the low curve lens processing mode is selected by the mode selector, a low curve bevel path for locating a bevel apex between the front surface and the rear surface using a predetermined computing equation on the basis of the edge positions detected by the edge position detector, thereby providing low curve beveling data for the V-groove beveling grindstone; and acquires, if the high curve lens processing mode is selected by the mode selector, a high curve bevel path for locating the bevel apex on the front surface or at a position shifted by a predetermined quantity from the front surface curve toward the rear side on the basis of the edge positions detected by the lens edge position detector, wherein if the bevel apex of the high curve bevel path is located on the front surface, the computing unit acquires first high curve beveling data for the rear beveling grindstone based on the high curve bevel path and the height data of the rear bevel slope, and if the bevel apex of the high curve bevel path is located at the position shifted by the predetermined quantity from the front surface toward the rear side, the computing unit acquires second high curve beveling data for the front and rear beveling grindstones based on the high curve bevel path and the height data of the rear bevel slope; and a beveling controller that in the low curve lens processing mode, performs beveling the peripheral edge of the eyeglass lens by the V-groove beveling grindstone on the basis of the low curve beveling data, and in the high curve lens processing mode, performs beveling the peripheral edge of the eyeglass lens by the rear surface beveling grindstone on the basis of the first high curve beveling data, or performs beveling the peripheral edge of the eyeglass lens by the front and rear beveling grindstones on the basis of the second high curve beveling data.

2. The eyeglass lens processing apparatus according to claim 1, wherein when the high curve processing mode is selected and the high curve bevel path is to be acquired so that the bevel apex is located at the position shifted by the predetermined quantity from the front surface toward the rear side, the computing unit acquires the high curve bevel path while changing the shifting quantity toward the rear side according to an edge thickness of the eyeglass lens detected by the lens edge position detector.

3. The eyeglass lens processing apparatus according to claim 1, wherein when the high curve processing mode is selected, the computing unit acquires, if an edge thickness of the eyeglass lens obtained by the edge position detector is not larger than a predetermined thickness, the high curve bevel path for locating the bevel apex on the front surface, and acquires, if the edge thickness of the eyeglass lens obtained by the edge position detector is larger than the predetermined thickness, the high curve bevel path for locating the bevel apex at the position shifted by the predetermined quantity from the front surface toward the rear side.

4. The eyeglass lens processing apparatus according to claim 1, wherein an angle of the rear beveling slope of the rear beveling grindstone relative to an axial direction of the lens chuck shafts is larger than an angle of the rear beveling slope of the V-groove beveling grindstone relative to the axial direction, and an angle of the rear beveling slope of the front beveling grindstone relative to the axial direction is smaller than an angle of the front beveling slope of the V-groove-beveling grindstone relative to the-axial direction.

5. The eyeglass lens processing apparatus according to claim 1, wherein:

the rear surface beveling grindstone includes a rear bevel foot processing slope for forming a bevel foot on the rear side;

the V-groove beveling grindstone includes a rear bevel foot processing slope for forming the rear bevel foot; and an angle of the rear bevel foot processing slope of the rear beveling grindstone relative to an axial direction of the lens chuck shafts is smaller than an angle of the rear beveling slope of the rear beveling grindstone relative to the axial direction and is larger than an angle of the rear bevel foot processing slope of the V-groove beveling grindstone relative to the axial direction.

6. The eyeglass lens processing apparatus according to claim 1, wherein:

the rear beveling grindstone includes a bevel foot processing slope for forming a bevel foot on the rear side;

an angle of the bevel foot processing slope relative to an axial direction of the lens chuck shafts is smaller than an angle of the rear beveling slope of the rear beveling grindstone relative to the axial direction, and the computing unit acquires the first or second high curve beveling data in which a height of the bevel apex relative to the rear bevel foot when the bevel slope is processed changes according to material of an eyeglass frame inputted by a frame material inputting unit.

7. The eyeglass lens processing apparatus according to claim 6, wherein the computing unit acquires the first or second high curve beveling data in which the bevel apex is located at a higher position when the material of the eyeglass frame is plastic than when the material is metal.

8. An eyeglass lens processing apparatus for beveling a peripheral edge of an eyeglass lens, comprising:

a lens chuck shaft which holds the eyeglass lens;

a V-groove beveling grindstone which simultaneously processes a bevel slope on a front side of the eyeglass lens and a bevel slope on a rear side of the eyeglass lens;

a front beveling grindstone and a rear beveling grindstone which individually process the bevel slope on the front side and the bevel slope on the rear side, respectively, wherein an angle of a beveling slope of the rear beveling grindstone relative to an axial direction of the lens chuck shaft is larger than an angle of a rear beveling slope of the V-groove beveling grindstone relative to the axial direction, and an angle of a beveling slope of the front beveling grindstone relative to the axial direction is smaller than an angle of a front beveling slope of the V-groove beveling grindstone relative to the axial direction;

a lens edge position detector which detects edge positions of a front and a rear of the eyeglass lens on the basis of target lens shape data;

a mode selector which selects a low curve lens processing mode and a high curve processing mode;

a computing unit which acquires, if the low curve lens processing mode is selected by the mode selector, a low curve bevel path for locating a bevel apex between the front surface and the rear surface using a predetermined computing equation on the basis of the edge positions detected by the edge position detector, thereby providing low curve beveling data for the V-groove beveling grindstone; and acquires, if the high curve lens processing mode is selected by the mode selector, a high curve bevel path for locating the bevel apex on the front surface of the eyeglass lens or for locating the bevel apex at a position shifted by a predetermined quantity from the front surface toward the rear side on the basis of the edge positions detected by the edge position detector, thereby providing high curve beveling data for the rear beveling grindstone, or for the front and rear beveling grindstones; and a beveling controller which bevels, in the low curve lens processing mode, the peripheral edge of the eyeglass lens by the V-groove beveling grindstone on the basis of the low curve beveling data, and bevels, in the high curve lens processing mode, the peripheral edge of the eyeglass lens by the rear beveling grindstone, or by the front and rear beveling grindstones on the basis of the high curve beveling data.

* * * * *